US011772391B2

(12) United States Patent
Zielenski et al.

(10) Patent No.: US 11,772,391 B2
(45) Date of Patent: Oct. 3, 2023

(54) DEVICES, SYSTEMS, AND METHODS FOR CONTROLLING AIRFLOW THROUGH VACUUM PLATEN OF PRINTING SYSTEM BY A MOVABLE DAMPER

(71) Applicant: XEROX CORPORATION, Norwalk, CT (US)

(72) Inventors: Megan Zielenski, Holland Patent, NY (US); John Patrick Baker, Rochester, NY (US); Brian M. Balthasar, North Tonawanda, NY (US); Emmett James Spence, Honeoye Falls, NY (US); Robert Jian Zhang, Brighton, NY (US)

(73) Assignee: Xerox Corporation, Norwalk, CT (US)

( * ) Notice: Subject to any disclaimer, the term of this patent is extended or adjusted under 35 U.S.C. 154(b) by 10 days.

(21) Appl. No.: 17/217,399

(22) Filed: Mar. 30, 2021

(65) Prior Publication Data

US 2022/0314648 A1 Oct. 6, 2022

(51) Int. Cl.
*B41J 29/38* (2006.01)
*B41J 11/00* (2006.01)

(52) U.S. Cl.
CPC ..... *B41J 11/0085* (2013.01)

(58) Field of Classification Search
None
See application file for complete search history.

(56) References Cited

U.S. PATENT DOCUMENTS 8,388,246 B2 3/2013 Spence et al.
9,796,546 B1 * 10/2017 LeFevre ..... B65H 5/224
(Continued)

FOREIGN PATENT DOCUMENTS

CN 104044366 A 9/2014
EP 1449668 A1 * 8/2004 ..... B41J 11/0065
(Continued)

OTHER PUBLICATIONS

Tsuji, Masaaki, Ink-Jet Printer, Aug. 25, 2004, Europe (Year: 2004).*
E, Yuan-Bo, Impression Member Device And A Printing Device Having The Impression Member Device, Sep. 17, 2014, China (Year: 2014).*
Co-Pending U.S. Appl. No. 17/217,370, "Airflow Control Through Vacuum Platen of Printing System By a Movable Damper, and Related Devices, Systems, and Methods,", filed Mar. 30, 2021.
(Continued)

*Primary Examiner* — Erica S Lin
*Assistant Examiner* — Tracey M McMillion
(74) *Attorney, Agent, or Firm* — Jones Robb, PLLC

(57) ABSTRACT

A printing system comprises a media transport device which holds print media, such as paper, against a movable support surface, such as a belt, by vacuum suction through holes in the media transport device and transports the print media though a deposition region of one or more printheads, which deposit a print fluid, such as ink, on the print media. The printing system comprises an airflow control device comprising one or more dampers that are moveable in a cross-process direction between an undeployed configuration and a deployed configuration, each damper blocking at least one row of the holes in the deployed configuration. The airflow control device also comprises one or more actuators to move the damper(s). The actuator(s) are controlled to selectively move the damper(s) between the undeployed and deployed configuration based on a position of an inter-media zone between adjacent print media held against the movable support surface.

20 Claims, 20 Drawing Sheets

(56) References Cited

U.S. PATENT DOCUMENTS

| | | | |
|---|---|---|---|
| 9,815,303 | B1 | 11/2017 | Herrmann et al. |
| 9,944,094 | B1 | 4/2018 | Herrmann et al. |
| 10,688,778 | B2 | 6/2020 | Fromm et al. |
| 2002/0158937 | A1 | 10/2002 | Pietrzyk et al. |
| 2010/0208018 | A1 | 8/2010 | Snyder et al. |
| 2010/0276868 | A1 | 11/2010 | Moore et al. |
| 2011/0248441 | A1 | 10/2011 | Yamada |
| 2013/0050375 | A1 | 2/2013 | Ishimori et al. |
| 2016/0347091 | A1 | 12/2016 | Onuma et al. |
| 2018/0339529 | A1 | 11/2018 | Zirilli |
| 2020/0345545 | A1 | 11/2020 | Zhang |
| 2021/0138803 | A1 | 5/2021 | Lefevre et al. |

FOREIGN PATENT DOCUMENTS

| | | | |
|---|---|---|---|
| EP | 1449668 | A1 | 8/2004 |
| EP | 1 319 510 | B1 | 9/2009 |
| GB | 2 374 834 | A | 10/2002 |
| JP | 2011098521 | A | 5/2011 |

OTHER PUBLICATIONS

Co-Pending U.S. Appl. No. 17/217,388, "Airflow Control in a Printing System Using a Movable Baffle, and Related Devices, Systems, and Methods,", filed Mar. 30, 2021.

Co-Pending U.S. Appl. No. 17/217,411, "Devices, Systems, and Methods for Controlling Airflow Through Vacuum Platen of Printing System Via Airflow Zones,", filed Mar. 30, 2021.

Co-Pending U.S. Appl. No. 17/217,432, "Controlling Airflow Through Vacuum Platen of Printing System by a Movable Damper, and Related Devices, Systems, and Methods,", filed Mar. 30, 2021.

Co-Pending U.S. Appl. No. 17/217,448, "Devices, Systems, and Methods for Controlling Airflow Through Vacuum Platen of Printing System by Rotating Valve,", filed Mar. 30, 2021.

Co-Pending U.S. Appl. No. 17/217,466, "Airflow Control in a Printing System, and Related Devices, Systems, and Methods,", filed Mar. 30, 2021.

Cross-cited U.S. Appl. No. 17/217,370, Office Action dated Jun. 9, 2022.

* cited by examiner

DEVICES, SYSTEMS, AND METHODS FOR CONTROLLING AIRFLOW THROUGH VACUUM PLATEN OF PRINTING SYSTEM BY A MOVABLE DAMPER

FIELD

Aspects of this disclosure relate generally to inkjet printing, and more specifically to inkjet printing systems having a media transport device utilizing vacuum suction to hold and transport print media. Related devices, systems, and methods also are disclosed.

INTRODUCTION

In some applications, inkjet printing systems use an ink deposition assembly with one or more printheads, and a media transport device to move print media (e.g., a substrate such as sheets of paper, envelopes, or other substrate suitable for being printed with ink) through an ink deposition region of the ink deposition assembly (e.g., a region under the printheads). The inkjet printing system forms printed images on the print media by ejecting ink from the printheads onto the median as the media pass through the deposition region. In some inkjet printing systems, the media transport device utilizes vacuum suction to assist in holding the print median against a movable support surface (e.g., conveyor belt, rotating drum, etc.) of the transport device. Vacuum suction to hold the print median against the support surface can be achieved using a vacuum source (e.g., fans) and a vacuum plenum fluidically coupling the vacuum source to a side of the moving surface opposite from the side that supports the print medium. The vacuum source creates a vacuum state in the vacuum plenum, causing vacuum suction through holes in the movable support surface that are fluidically coupled to the vacuum plenum. When a print medium is introduced onto the movable support surface, the vacuum suction generates suction forces that hold the print medium against the movable support surface. The media transport device utilizing vacuum suction may allow print media to be securely held in place without slippage while being transported through the ink deposition region under the ink deposition assembly, thereby helping to ensure correct locating of the print media relative to the printheads and thus more accurate printed images. The vacuum suction may also allow print media to be held flat as it passes through the ink deposition region, which may also help to increase accuracy of printed images, as well as helping to prevent part of the print medium from rising up and striking part of the ink deposition assembly and potentially causing a jam or damage.

One problem that may arise in inkjet printing systems that include media transport device utilizing vacuum suction is unintended blurring of images resulting from air currents induced by the vacuum suction. In some systems, such blurring may occur in portions of the printed image that are near the edges of the print media, particularly those portions that are near the lead edge or trail edge in the transport direction of the print media. During a print job, the print median are spaced apart from one another on the movable support surface as they are transported through the deposition region of the ink deposition assembly, and therefore parts of the movable support surface between adjacent print median are not covered by any print media. Thus, adjacent to both the lead edge and the trail edge of each print medium there are uncovered holes in the movable support surface. Because these holes are uncovered, the vacuum of the vacuum plenum induces air to flow through those uncovered holes. This airflow may deflect ink droplets as they are traveling from a printhead to the substrate, and thus cause blurring of the image.

A need exists to improve the accuracy of the placement of droplets in inkjet printing systems and to reduce the appearance of blur of the final printed media product. A need further exists to address the blurring issues in a reliable manner and while maintaining speeds of printing and transport to provide efficient inkjet printing systems.

SUMMARY

Embodiments of the present disclosure may solve one or more of the above-mentioned problems and/or may demonstrate one or more of the above-mentioned desirable features. Other features and/or advantages may become apparent from the description that follows.

In accordance with at least one embodiment of the present disclosure, a printing system comprises an ink deposition assembly comprising one or more printheads arranged to eject a print fluid to a deposition region of the ink deposition assembly. The printing system further comprises a media transport device comprising a movable support surface, the media transport device configured to hold a print medium against the movable support surface by vacuum suction through holes in the media transport device and transport the print media along a process direction though the deposition region, the holes arranged in columns extending in the process direction and in rows extending in a cross-process direction. The printing system further comprises an airflow control system comprising a damper and an actuator. The damper is moveable in the cross-process direction between a deployed configuration and an undeployed configuration, the damper blocking at least one row of the holes in the deployed configuration and not blocking the at least one row of the holes in the undeployed configuration. The actuator is operably coupled to the damper and configured to move the damper between the undeployed configuration and the deployed configuration.

In accordance with at least one embodiment of the present disclosure, a controller is configured to cause the actuator to selectively move the damper between the undeployed configuration and the deployed configuration to selectively block the at least one row of the holes based on a position of an inter-media zone between adjacent print media held against the movable support surface.

In accordance with at least one embodiment of the present disclosure, a method comprises transporting a print medium through a deposition region of a printhead of the printing system. The print medium is held during the transporting against a moving support surface of a media transport device via vacuum suction through holes in the media transport device, the holes arranged in columns extending in the process direction and in rows extending in a cross-process direction. The method further comprises ejecting print fluid from the printhead to deposit the print fluid to the print medium in the deposition region. The method also comprises controlling an airflow control system to selectively block at least one row of the holes by moving a damper between a deployed configuration in which the damper blocks at least one row of the holes and an undeployed configuration in which the damper does not block any of the holes in damper.

In accordance with at least one embodiment of the present disclosure, selectively blocking the at least one row of the holes comprises moving the damper between the deployed and undeployed configurations based on a position of an inter-media zone between adjacent print media held against the moving support surface.

BRIEF DESCRIPTION OF THE DRAWINGS

The present disclosure can be understood from the following detailed description, either alone or together with the accompanying drawings. The drawings are included to provide a further understanding of the present disclosure and are incorporated in and constitute a part of this specification. The drawings illustrate one or more embodiments of the present teachings and together with the description explain certain principles and operation. In the drawings.

DETAILED DESCRIPTION

Figure 1A:
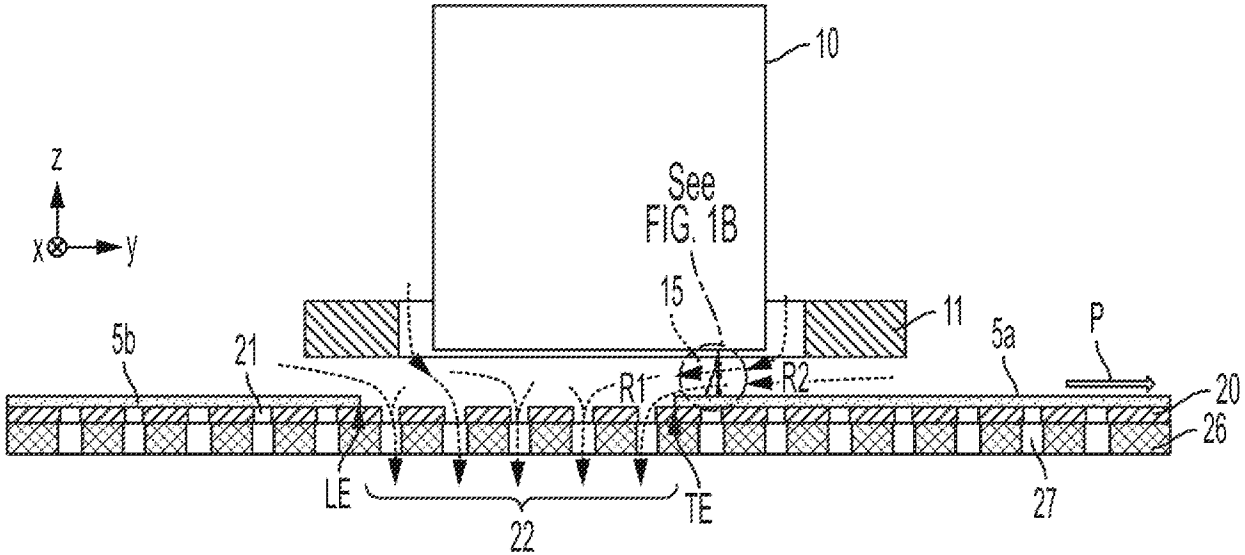
FIG. 1A RELATED ART
FIGS. 1A-1I schematically illustrate air flow patterns relative to a printhead assembly, transport device, and print media during differing stages of print media transport through an ink deposition region of a conventional inkjet printing system, and resulting blur effects in the printed media product.
Figure 1C:
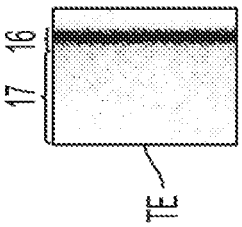
Figure 1B:
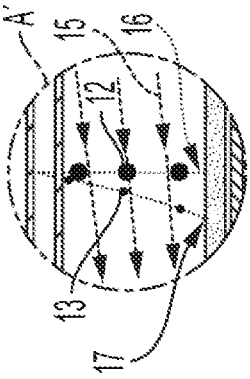
Figure 1D:
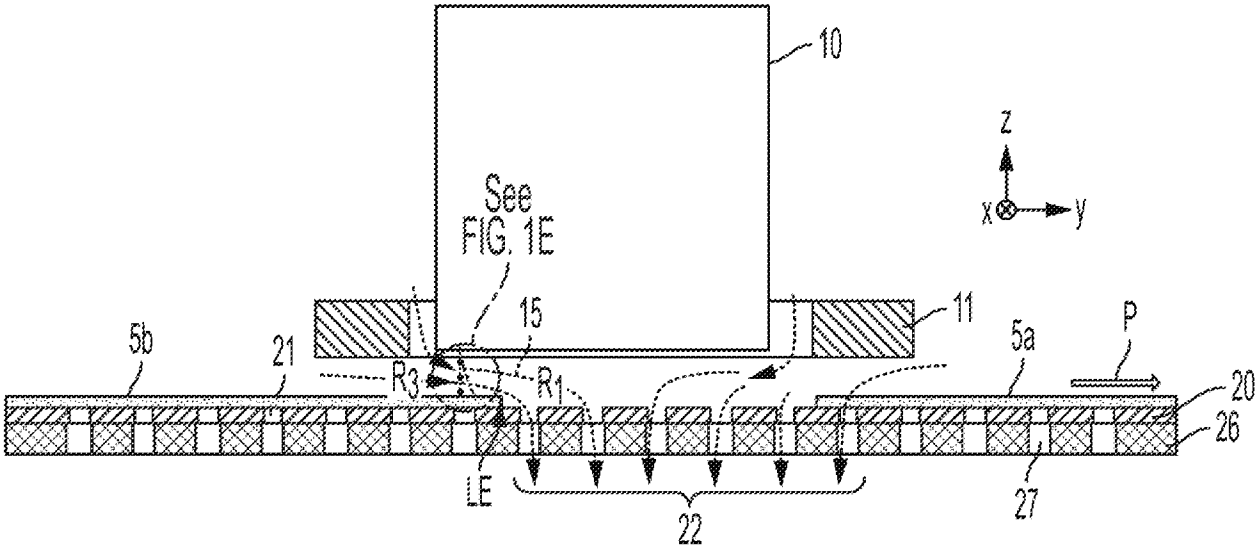
FIG. 1D RELATED ART
Figure 1F:
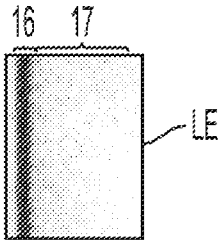
Figure 1E:
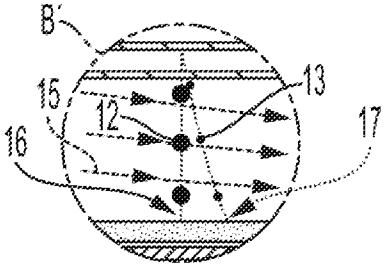
Figure 1G:
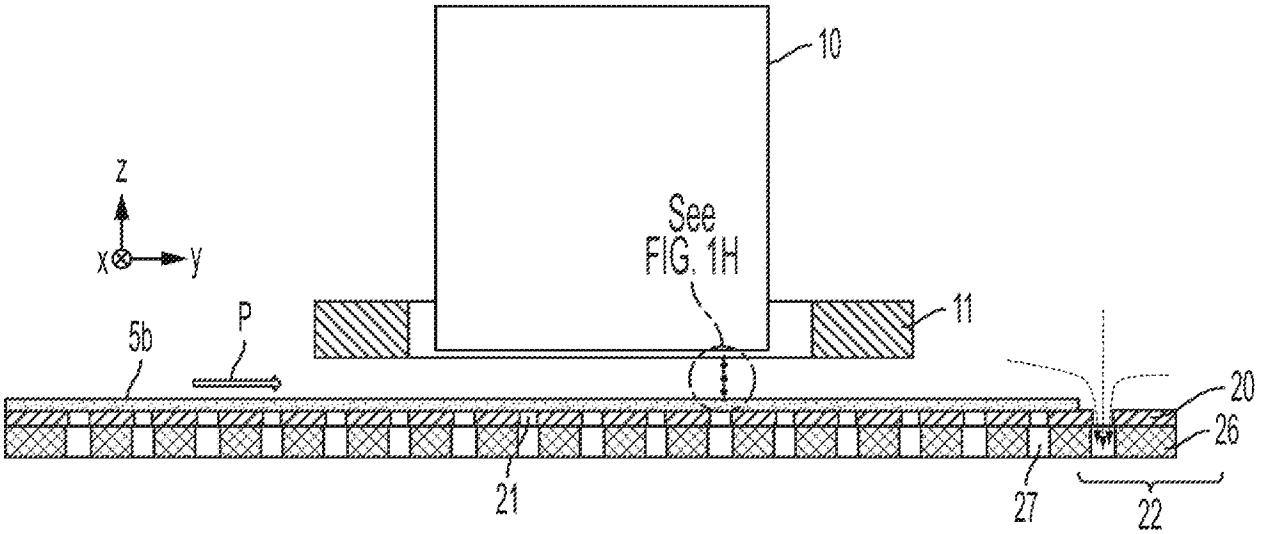
FIG. 1G RELATED ART
Figure 1I:
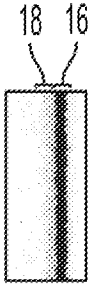
Figure 1H:
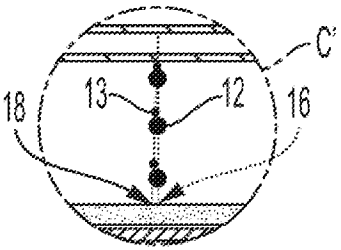

As described above, when an inter-media zone is near or under a printhead, the uncovered holes in the inter-media zone can create crossflows that can blow satellite droplets off course and cause image blur. To better illustrate some of the phenomenon occurring giving rise to the blurring issues, reference is made to FIGS. 1A-1I. FIGS. 1A, 1D, and 1G illustrate schematically a printhead 10 printing on a print medium 5 near a trail edge TE, a lead edge LE, and a middle, respectively, of the print medium 5. FIGS. 1B, 1E, and 1H illustrate enlarged views of the regions A, B, and C, respectively. FIGS. 1C, 1F, and 1I illustrate enlarged pictures of printed images, the printed images comprising lines printed near the trail edge TE, lead edge LE, and middle, respectively, of a sheet of paper.

As shown in FIGS. 1A, 1D, and 1G, the inkjet printing system comprises a printhead 10 to eject ink to a print medium **5*a* near a trail edge TE of the print medium 5*a*, and a movable support surface 20 transports the print media 5 in a process direction P, which corresponds to a positive y-axis direction in the Figures. The movable support surface 20 slides along a top of a vacuum platen 26, and a vacuum environment is provided on a bottom side of the platen 26. The movable support surface 20 has holes 21 and the vacuum platen 26 has holes 27, and the holes 21 and 27 periodically align as the movable support surface 20 moves so as to expose the region above the movable support surface 20 to the vacuum below the platen 26. In regions where the print medium 5 covers the holes 21, the vacuum suction through the aligned holes 21 and 27 generates a force that holds the print medium 5 against the movable support surface 20. However, little or no air flows through these covered holes 21 and 27 since they are blocked by the print medium 5. On the other hand, as shown in FIGS. 1A and 1D, in the inter-media zone 22 the holes 21 and 27 are not covered by the print media 5, and therefore the vacuum suction pulls air to flow down through the holes 21 and 27 in the inter-media zone 22. This creates airflows, indicated by the dashed arrows in FIGS. 1A and 1D, which flow from regions around the printhead 10 towards the uncovered holes 21 and 27 in the inter-media zone 22, with some of the airflows passing under the printhead 10**.

In FIG. 1A, the print medium **5*a* is being printed on near its trail edge TE, and therefore the region where ink is currently being ejected ("ink-ejection region") (e.g., the circled region in FIG. 1A) is located downstream of the inter-media zone 22 (upstream and downstream being defined with respect to the process direction P). Accordingly, some of the air being sucked towards the inter-media zone 22 will flow upstream through the ink-ejection region. More specifically, the vacuum suction from the inter-media zone 22 lowers the pressure in the region immediately above the inter-media zone 22, e.g., region $R_1$ in FIG. 1A, while the region downstream of the printhead 10, e.g., region $R_2$ in FIG. 1A, remains at a higher pressure. This pressure gradient causes air to flow in an upstream direction from the region $R_2$ to the region $R_1$, with the airflows crossing through the ink-ejection region (e.g., the circled region in FIG. 1A) which is between the regions $R_1$ and $R_2$. Airflows such as these, which cross through the ink-ejection region, are referred to herein as crossflows 15. In FIG. 1A, the crossflows 15 flow upstream, but in other situations the crossflows 15** may flow in different directions.

As shown in the enlarged view A' in FIG. 1B, which comprises an enlarged view of the circled region in FIG. 1A, as ink is ejected from the printhead 10 towards the medium 5, main droplets 12 and satellite droplets 13 are formed. The satellite droplets 13 are much smaller than the main droplets 12 and have less mass and momentum, and thus the upstream crossflows **15*a* tend to affect the satellite droplets 13 more than the main droplets 12. Thus, while the main droplets 12 may land on the print medium 5 near their intended deposition location 16 regardless of the crossflows 15, the crossflows 15 may push the satellite droplets 13 away from the intended trajectory so that they land at an unintended location 17 on the medium 5, the unintended location 17 being displaced from the intended location 16. This can be seen in the actual printed image in FIG. 1C, in which the denser/darker line-shaped portion is formed by the main droplets 12 which were deposited predominantly at their intended locations 16, whereas the smaller dots dispersed away from the line are formed by satellite droplets 13 which were blown away from the intended locations 16 to land in unintended locations 17, resulting in a blurred or smudged appearance for the printed line. Notably, the blurring in FIG. 1C is asymmetrically biased towards the trail edge TE, due to the crossflows 15 near the trail edge TE blowing primarily in an upstream direction. The inter-media zone 22 may also induce other airflows flowing in other directions, such as downstream airflows from an upstream side of the printhead 10**, but these other airflows do not pass through the region where ink is currently being ejected in the illustrated scenario and thus do not contribute to image blur. Only those airflows that cross through the ink ejection region are referred to herein as crossflows.

FIGS. 1D-1F illustrate another example of such blurring occurring, but this time near the lead edge LE of the print medium 5*b*. The cause of blurring near the lead edge LE as shown in FIGS. 1C and 1D is similar to that described above in relation to the trail edge TE, except that in the case of printing near the lead edge LE the ink-ejection region is now located upstream of the inter-media zone 22. As a result, the crossflows 15 that are crossing through the ink-ejection region now originate from the upstream side of the printhead 10, e.g., from region $R_3$, and flow downstream. Thus, as shown in the enlarged view B' of FIG. 1E, which comprises an enlarged view of the circled region in FIG. 1D, in the case of printing near the lead edge LE, the satellite droplets 13 are blown downstream towards the lead edge LE of the print medium 5*b* (positive y-axis direction). As shown in FIG. 1F, this results in asymmetric blurring that is biased towards the lead edge LE.

In contrast, as shown in FIG. 1H and the enlarged view C' in FIG. 1H, which corresponds to an enlarged view of the circled region in FIG. 1G, farther from the edges of the print media 105 there may be little or no crossflows 15 because the inter-media zone 22 is too distant to induce much airflow. Because the crossflows 15 are absent or weak farther away from the edges of the print medium 5, the satellite droplets 13 in this region are not as likely to be blown off course. Thus, as shown in FIGS. 1H and 1I, when printing farther from the edges of the print medium 5*b*, the satellite droplets land at locations 18 that are much closer to the intended locations 16 resulting in much less image blurring. The deposition locations 18 of the satellite droplets may still vary somewhat from the intended locations 16, due to other factors affecting the satellite droplets 13, but the deviation is smaller than it would be near the lead or trail edges.

Embodiments disclosed herein may, among other things, reduce or eliminate such image blur by utilizing an airflow control system that reduces or eliminates the crossflows. With the crossflows reduced or eliminated, the satellite droplets are more likely to land closer to or at their intended deposition locations, and therefore the amount of blur is reduced. Airflow control systems in accordance with various embodiments reduce or eliminate the crossflows by selectively blocking holes of the media transport device in the proximity of the printheads when an inter-media zone is near or under the printheads. In various embodiments, dampers are positioned relative to the transport device and configured to be movable in a cross-process direction between a deployed (extended) configuration and an undeployed (retracted) configuration or configuration to block and unblock holes in the platen of the transport device. In the deployed (extended) configuration, the damper is positioned against the bottom side of the platen under one or more rows of the holes and blocks airflow through those holes, and thus through the holes in the movable support surface. In the undeployed (retracted) configuration, the damper is moved away and does not block the holes, thus allowing the vacuum suction to suck air through the holes in the movable support surface and the platen. The timings at which the dampers are deployed (extended) may be controlled based on the location of the inter-media zone such that the dampers block holes near the printhead when the inter-media zone is in the deposition region under the printhead, thereby preventing the holes in the inter-media zone from sucking in air from above the movable support surface and creating the crossflows. The dampers may be retracted when the inter-media zone has passed the damper, so as allow the holes to resume sucking the air in and applying the suction hold down force to the print media. With the crossflows reduced or eliminated, the satellite droplets are more likely to land at or nearer to their intended deposition locations, and therefore the amount of blur is reduced.

Figure 2:
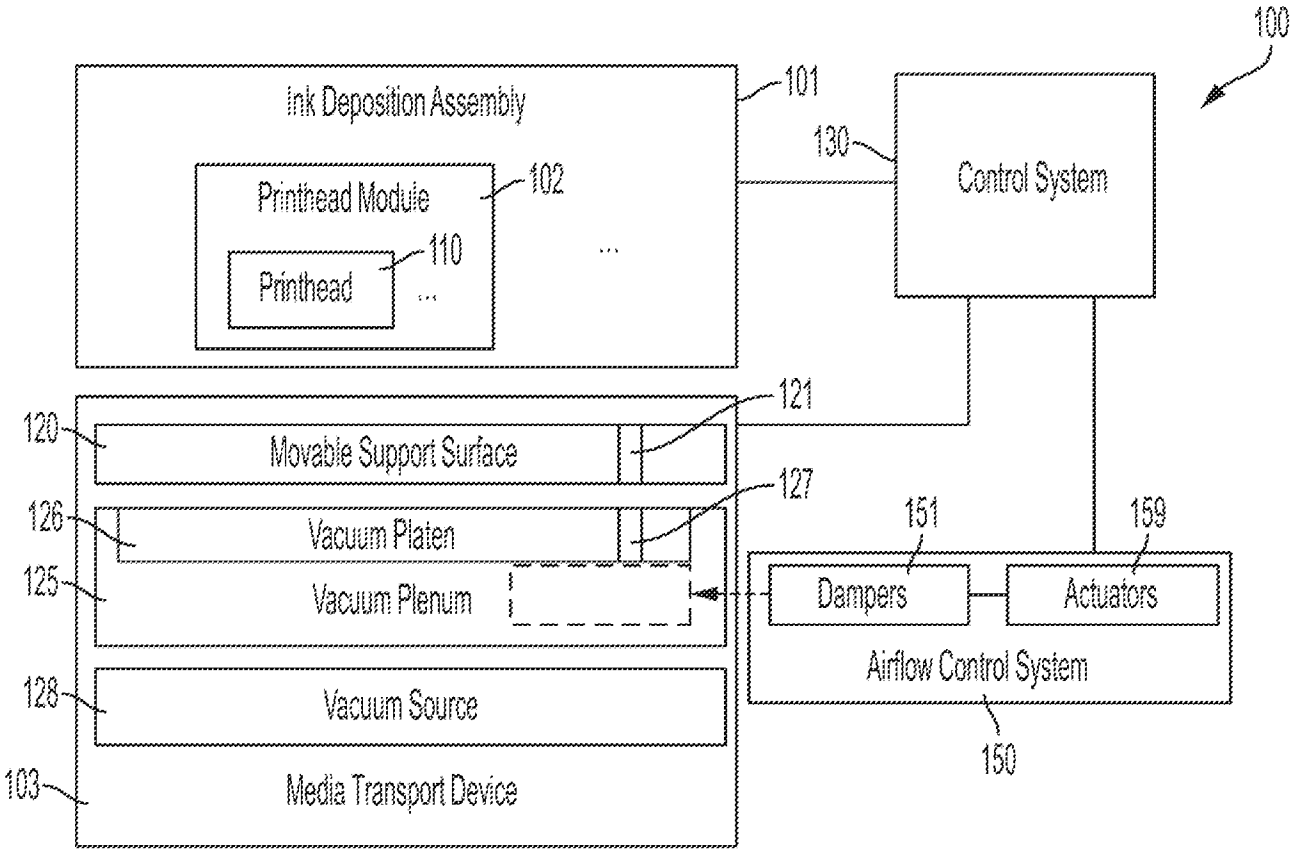
FIG. 2 comprises is a block diagram illustrating components of an embodiment of an inkjet printing system including an air flow control system.

FIG. 2 is a block diagram schematically illustrates a printing system 100 utilizing the above-described airflow control system. The printing system 100 comprises an ink deposition assembly 101, a media transport device 103, an airflow control system 150, and a control system 130. These components of the printing system 100 are described in greater detail in turn below.

The ink deposition assembly 101 comprises one or more printhead modules 102. One printhead module 102 is illustrated in FIG. 2 for simplicity, but any number of printhead modules 102 may be included in the ink deposition assembly 101. In some embodiments, each printhead module 102 may correspond to a specific ink color, such as cyan, magenta, yellow, and black. Each printhead module 102 comprises one or more printheads 110 configured to eject print fluid, such as ink, onto the print media to form an image. In FIG. 2, one printhead 110 is illustrated in the printhead module 102 for simplicity, but any number of printheads 110 may be included per printhead module 102. The printhead modules 102 may also include additional structures and devices to support and facilitate operation of the printheads 110, such as carrier plates 111, ink supply lines, ink reservoirs, electrical connections, and so on, as known in the art.

As shown in FIG. 2, the media transport device 103 comprises a movable support surface 120, a vacuum plenum 125, and a vacuum source 128. The movable support surface 120 transports the print media through a deposition region of the ink deposition assembly 101. The vacuum plenum 125 supplies vacuum suction to one side of the movable support surface 120 (e.g., a bottom side), and print median is supported on an opposite side of the movable support surface 120 (e.g., a top side). Holes 121 through the movable support surface 120 communicate the vacuum suction through the surface 120, such that the vacuum suction holds down the print median against the surface 120. The movable support surface 120 is movable relative to the ink deposition assembly 101, and thus the print media held against the movable support surface 120 is transported relative to the ink deposition assembly 101 as the movable support surface 120 moves. Specifically, the movable support surface 120 transports the print media through a deposition region of the ink deposition assembly 101, the deposition region being a region in which print fluid (e.g., ink) is ejected onto the print media, such as a region under the printhead(s) 110. The movable support surface 120 can comprise any structure capable of being driven to move relative to the ink deposition assembly 101 and which has holes 121 to allow the vacuum suction to hold down the print media, such as a belt, a drum, etc. The vacuum plenum 125 comprises baffles, walls, or any other structures arranged to enclose or define an environment in which a vacuum state (e.g., low pressure state) is maintained by the vacuum source 128, with the plenum 125 fluidically coupling the vacuum source 128 to the movable support surface 120 such that the movable support surface 120 is exposed to the vacuum state within the vacuum plenum 125. In some embodiments, the movable support surface 120 is supported by a vacuum platen 126, which may be a top wall of the vacuum plenum 125. In such an embodiment, the movable support surface 120 is fluidically coupled to the vacuum in the plenum 125 via holes 127 through the vacuum platen 126. In some embodiments, the movable support surface 120 is itself one of the walls of the vacuum plenum 125 and thus is exposed directly to the vacuum in the plenum 125. The vacuum source 128 may be any device configured to remove air from the plenum 125 to create the low-pressure state in the plenum 125, such as a fan, a pump, etc.

The control system 130 comprises processing circuitry to control operations of the printing system 100. The processing circuitry may include one or more electronic circuits configured with logic for performing the various operations described herein. The electronic circuits may be configured with logic to perform the operations by virtue of including dedicated hardware configured to perform various operations, by virtue of including software instructions executable by the circuitry to perform various operations, or any combination thereof. In examples in which the logic comprises software instructions, the electronic circuits of the processing circuitry include a memory device that stores the software and a processor comprising one or more processing devices capable of executing the instructions, such as, for example, a processor, a processor core, a central processing unit (CPU), a controller, a microcontroller, a system-on-chip (SoC), a digital signal processor (DSP), a graphics processing unit (GPU), etc. In examples in which the logic of the processing circuitry comprises dedicated hardware, in addition to or in lieu of the processor, the dedicated hardware may include any electronic device that is configured to perform specific operations, such as an Application Specific Integrated Circuit (ASIC), a Field Programmable Gate Array (FPGA), a Complex Programmable Logic Device (CPLD), discrete logic circuits, a hardware accelerator, a hardware encoder, etc. The processing circuitry may also include any combination of dedicated hardware and general-purpose processor with software.

The airflow control system 150 comprises one or more dampers 151 and corresponding actuators 159. The dampers 151 are arranged inside the vacuum plenum 125 on a side of the vacuum platen 126 opposite the side that faces the movable support surface 120. Each damper 151 is independently movable in a cross-process direction (i.e., perpendicular to the process direction P) between an undeployed (retracted) configuration and a deployed (extended) configuration to selectively block one or more rows of platen holes 127. In this context, "row" refers to a subset of holes 127 that are aligned with one another in a cross-process direction (x-axis direction with reference to the orientation illustrated in the figures). In the deployed (extended) configuration, the damper 151 extends across the width of the vacuum platen 126 in the cross-process direction such that it blocks each hole 127 in the corresponding row or rows of holes 127. Each of the dampers 151 is positioned near a corresponding one of the printheads 110 so as to block holes 127 that are near the printhead 110. For example, in some embodiments, each printhead 110 has a first damper 151 positioned to block rows of holes 127 including at least one row immediately upstream of the printhead 110 and a second damper 151 positioned to block rows of holes 127 including at least one row immediately downstream of the printhead 110. In some embodiments, each printhead 110 also has one or more additional dampers 151 located between the first and second dampers to block holes 127 directly under the printhead 110. In particular, in some embodiments the dampers 151 associated with each printhead 110 collectively block at least every hole 127 that is located under the corresponding printhead 110. In some embodiments, each printhead module 102 may have a number of dampers 151 associated therewith, and the dampers 151 associated with a given printhead module 102 may be arranged to collectively block each row of holes 127 that is located under the given printhead module 102.

The actuator 159 is a device configured to drive movement of the damper 151 in the cross-process direction between the undeployed (retracted) and deployed (extended) configurations. The actuator 159 can be of a variety of types, including but not limited to, for example, a hydraulic or pneumatic piston, a solenoid, a linear actuator, etc. The actuator 159 may utilize electrical motive power, hydraulic motive power, pneumatic motive power, or any other desired motive power. The actuator 159 may also comprise rotary actuators, together with a rotary-to-linear conversion mechanism to convert rotary motion into linear motion of the damper 151.

The airflow control system 150 is configured to selectively block rows of the holes 127 based on the location of the inter-media zone 122, or in other words based on the locations of the lead edges LE and trail edges TE of the print media 105. "Selectively" in this context refers to the capability of the airflow control system 150 to independently move the dampers 151, during printing operations of the printing system 100, between deployed (extended) and undeployed (retracted) configurations in which the holes 127 are blocked and not blocked, respectively. Moreover, selectively blocking the holes based on the location of the inter-media zone can occur by the airflow control system 150 independently moving the dampers 151 at timings that correspond to positions (which may be predetermined or determined dynamically) of the inter-media zone 122—e.g., positions of the inter-media zone 122 are used as triggers for changing the dampers 151 between deployed (raised) and undeployed (lowered) configurations. The positions may be defined relative to a reference location or object, such as a printhead 110 (or part thereof), a damper 151 (or part thereof), etc. As will be explained further below, a determination of where an inter-media zone is located may be made based on detecting positions of the print media.

In some embodiments, each damper 151 is moved into the deployed (extended) configuration when the inter-media zone 122 is located near or under the corresponding printhead 110 or printhead module 102 associated with the damper 151. More specifically, in some embodiments, each damper 151 is deployed when the downstream edge of the inter-media zone 122 (which corresponds to the trail edge TE of a print medium 105) is at an upstream position associated with the damper 151. Conversely, each damper 151 is undeployed when the upstream edge of the inter-media zone 122 (which corresponds to the lead edge LE of a print medium 105) reaches a downstream position associated with the damper 151. In some embodiments, the upstream position associated with a given damper 151 is an upstream edge of the damper 151 and the downstream position associated with the damper 151 is a downstream edge of the damper 151. In some embodiments, the upstream position associated with a given damper 151 is an upstream boundary of the subset of holes 127 blocked by the damper 151, and the downstream position associated with the damper 151 is a downstream boundary of the subset of holes 127 blocked by the damper 151. In some embodiments, the upstream position associated with a given damper 151 is any predetermined position on an upstream side of the damper 151, while the downstream position associated with the given damper 151 is any predetermined position on a downstream side of the damper 151. In some embodiments, rather than deploying and retracting a damper 151 based on the location of the inter-media zone 122 relative to the damper 151, the damper 151 may be deployed and retracted based on the location of the inter-media zone 122 relative to some other object or location, such as the printhead 110, printhead module 102, etc.

Thus, in some embodiments, a given damper 151 is deployed whenever at least part of the inter-media zone 122 is located above the given damper 151 and is retracted when the inter-media zone 122 has moved past the given damper 151. Moreover, in some embodiments, a group of dampers 151 are positioned throughout a region under a printhead module 102 to collectively block airflow through any portion of the inter-media zone 122 that is located under a printhead 110 as the inter-media zone 122 moves under the printhead module 102. Positioning and actuation of the dampers in accordance with an embodiment are discussed in greater detail below in relation to FIGS. 5A-5F.

An issue associated with blocking holes 127 is that it can interfere with the hold down force being applied to the print medium 105. For example, if the holes 127 near the printheads 110 were permanently blocked or eliminated entirely, this would permanently reduce or eliminate all hold down force in the vicinity of the printheads 110, which might in some circumstances result in the leading edge of print media 105 rising off the movable support surface 120, potentially causing jams in the printing system and/or less accurate printing of images on the print medium. In contrast, in the approach described above, the dampers 151 are extended only for a relatively brief period of time (e.g., as the inter-media zone 122 moves past the blocker 151/printhead 110) and they are retracted thereafter, and therefore the hold down force may be applied without interference for most of the printing process. Moreover, even while the dampers 151 are extended, their interference with the hold down force is sufficiently small that the risk of the print media 105 rising off the movable support surface 120 is eliminated or acceptably small. In particular, for most of the period in which the damper 151 is extended, the holes 127 that are blocked by the damper 151 are not covered by any print medium 105 (i.e., the inter-media zone 122 is above the damper 151), and therefore the damper 151 is not interfering with the hold down of any print medium 105. The dampers 151 may block some holes 127 covered by a print medium 105 briefly, for example near the edges of the inter-media zone 122, but because the dampers 151 are deployed and retracted based on the position of the inter-media zone, generally only a relatively few of the holes 127 covered by print media 105 are blocked at by the blockers 151 at any given time. Thus, the portion of the print medium 105 that is not actively being subjected to hold down suction at any given time is kept relatively small. Accordingly, although deploying the dampers 151 to the deployed (extended) configuration does reduce the hold down force on the print media 105, the reduction in hold down force is sufficiently limited in time and space that the print media 105 is still held against the movable support surface 120 with a force sufficient to prevent the print media from lifting off and/or slipping relative to the movable support surface 120. In addition, as described further below, the reduction in hold down force due to the dampers 151 can be further tuned, if desired, by adjusting the width and number of the dampers 151.

A controller, which may be part of the control system 130, is configured to determine when to extend and retract the dampers 151. The controller also generates signals to control the actuators 159 to cause the actuators 159 to move the dampers 151 at the determined timings. The controller comprises one or more electronic circuits configured with logic to perform the options described herein. In some embodiments, the electronic circuits of the controller are part of the processing circuitry of the control system 130 described above, and therefore the controller is not separately illustrated in FIG. 2.

A location tracking system may be used to track the locations of the inter-media zones 122 and/or print media 105 as the print media 105 are transported through the ink deposition assembly. As used herein, tracking the location of the inter-media zones 122 or the print media 105 refers to the system having knowledge, whether direct or inferred, of where the print media 105 are located at various points as they are transported through the ink deposition assembly 101. Direct knowledge of the locations of the inter-media zones 122 or print media 105 may comprise information obtained by directly observing the print media 105, for example via one or more sensors (e.g., an edge detection sensor). Inferred knowledge of the locations of the inter-media zones 122 or print media 105 may be obtained by inference from other known information, for example by calculating how far a print medium 105 would have moved from a previously known location based on a known speed of the movable support surface 120. In some embodiments, the location tracking system may explicitly track locations of the inter-media zones 122, the lead edges LE of print media 105, and/or the trail edges TE of print media 105. In other embodiments, the location tracking system may explicitly track the locations of some other parts of the print medium 105. Because the locations of the inter-media zones 122 depend deterministically on the locations of the print media 105 and on the dimensions of the print media 105 (which are known to the controller), tracking the locations of some arbitrary part of the print media 105 is functionally equivalent to tracking the locations of the inter-media zones 122.

Most existing printing systems are already configured to track the locations of the print media 105 as they are transported through the ink deposition assembly, as knowledge of the locations of the print media may be helpful to ensure accurate image formation on the print media. Thus, various systems for tracking the locations of print median are well known in the art. Because such location tracking systems are well known, they will not be described in detail herein. Any known location tracking system (or any new location tracking system) may be used in the embodiments disclosed herein to track the location of print media, and a controller may use this information to determine the locations of the lead edge LE and/or the trail edge TE (if not already known).

Figure 3:
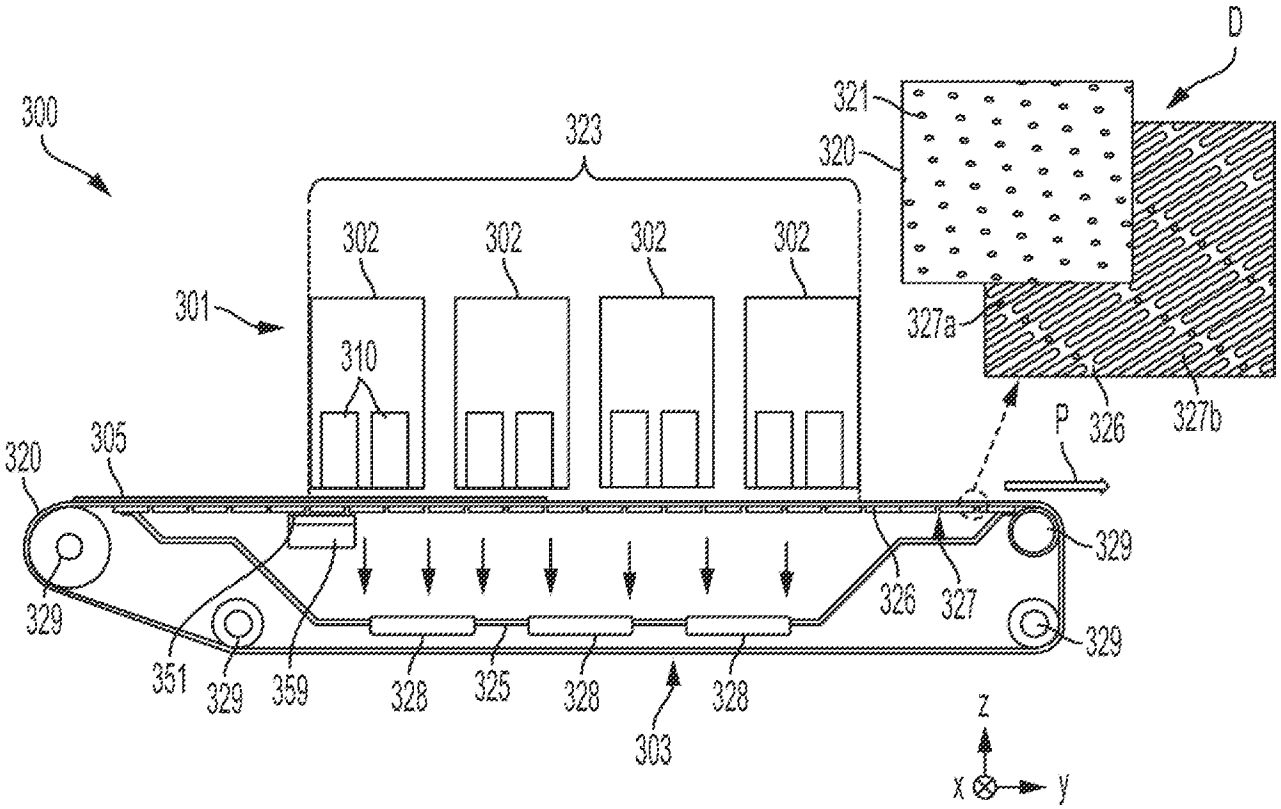
FIG. 3 is a schematic illustration of components of an embodiment of an inkjet printing system including an air flow control system.
Figure 4:
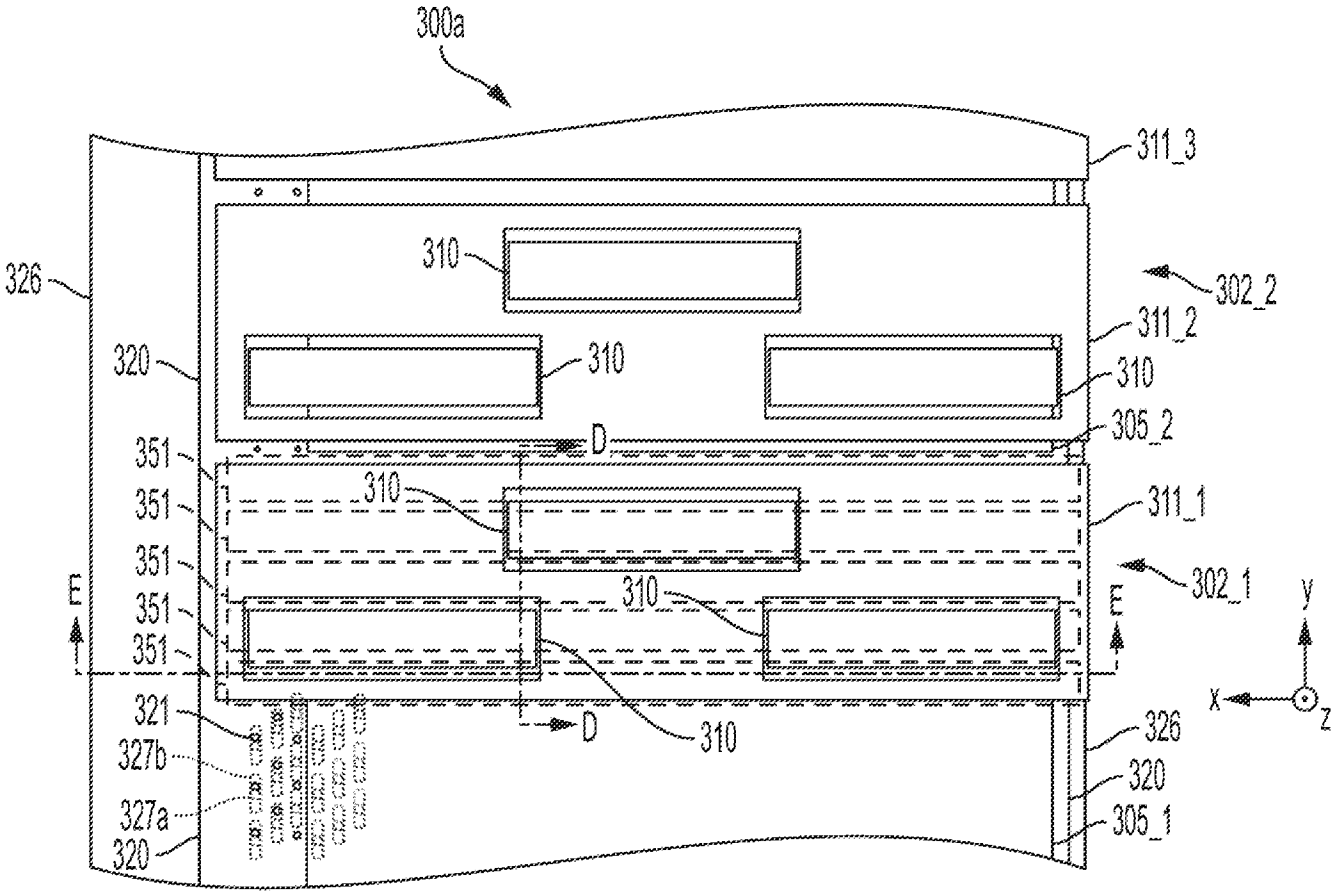
FIG. 4 is a plan view from above the printhead assembly of the inkjet printing system of FIG. 3.
Figure 5A:
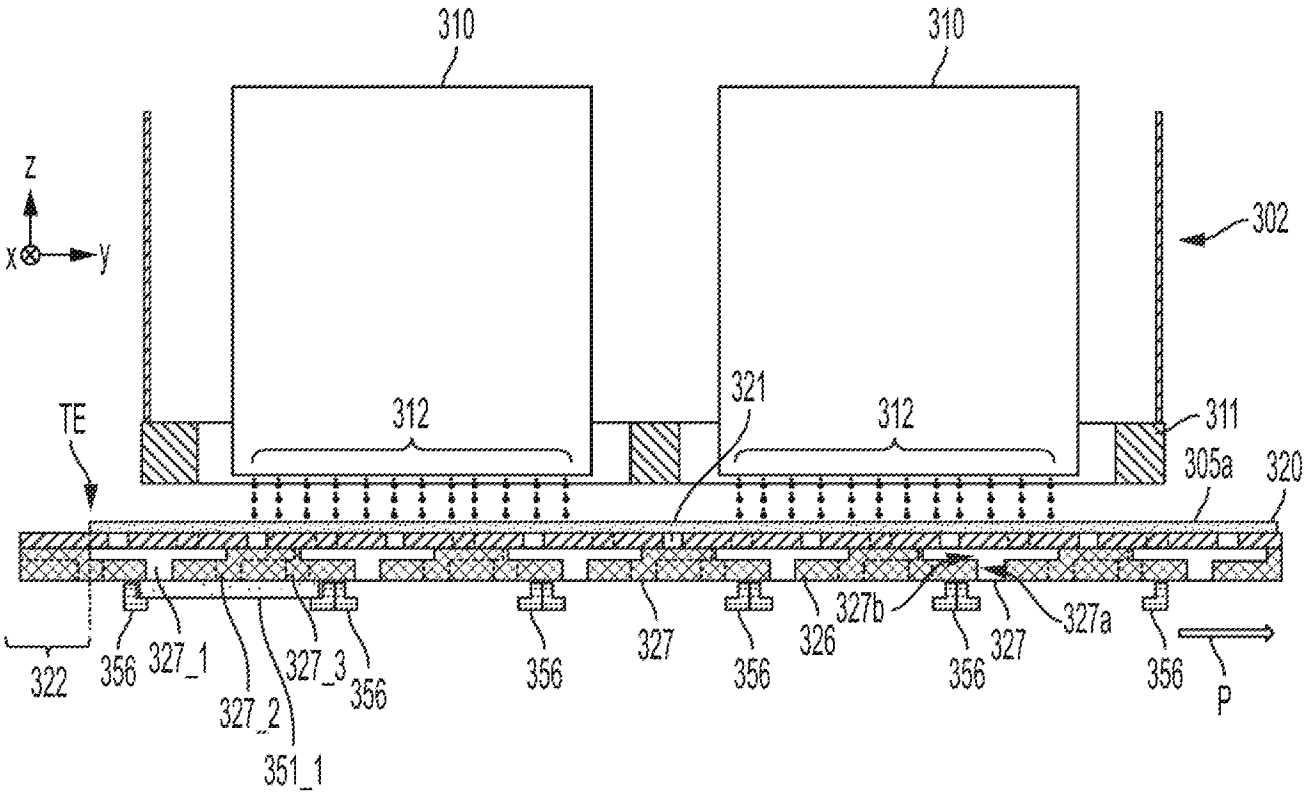
FIGS. 5A-5J are cross-sectional views of the inkjet printing system of FIG. 4, with the cross-section taken along D in FIG. 4.
Figure 5B:
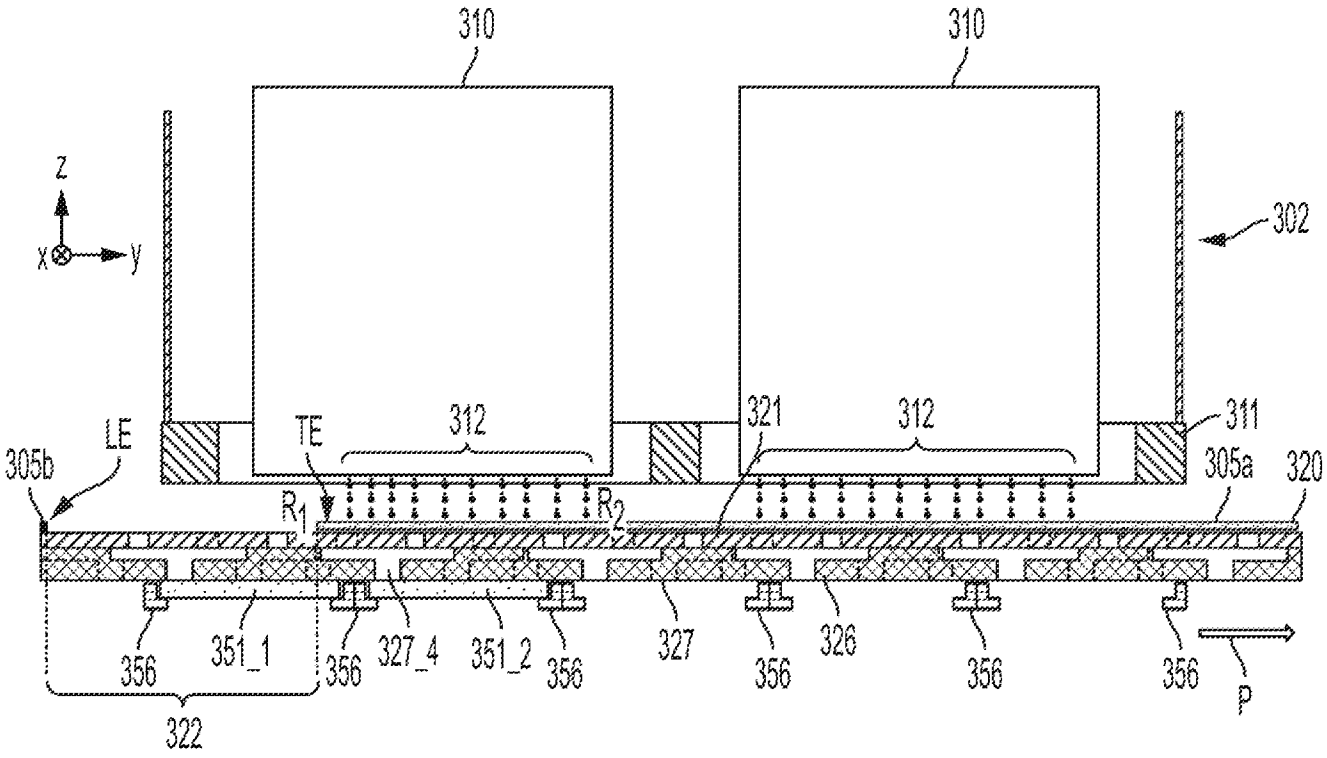
Figure 5C:
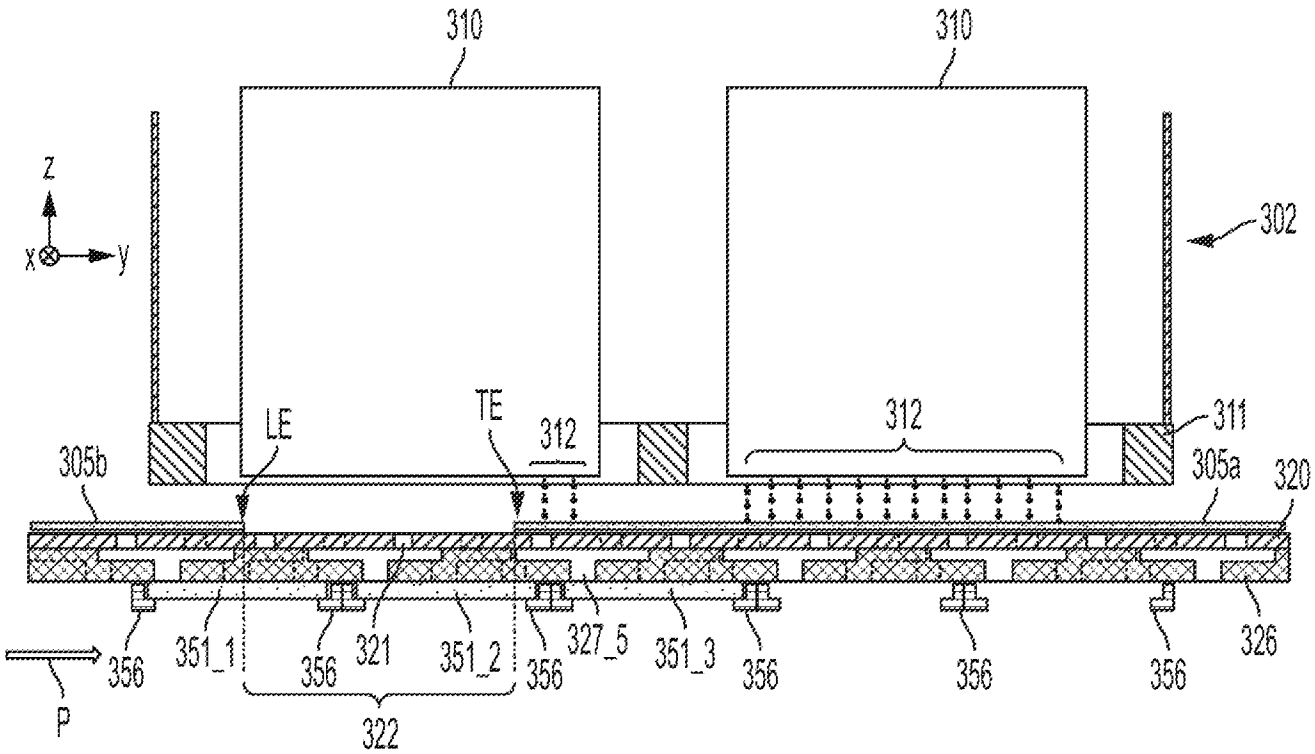
Figure 5D:
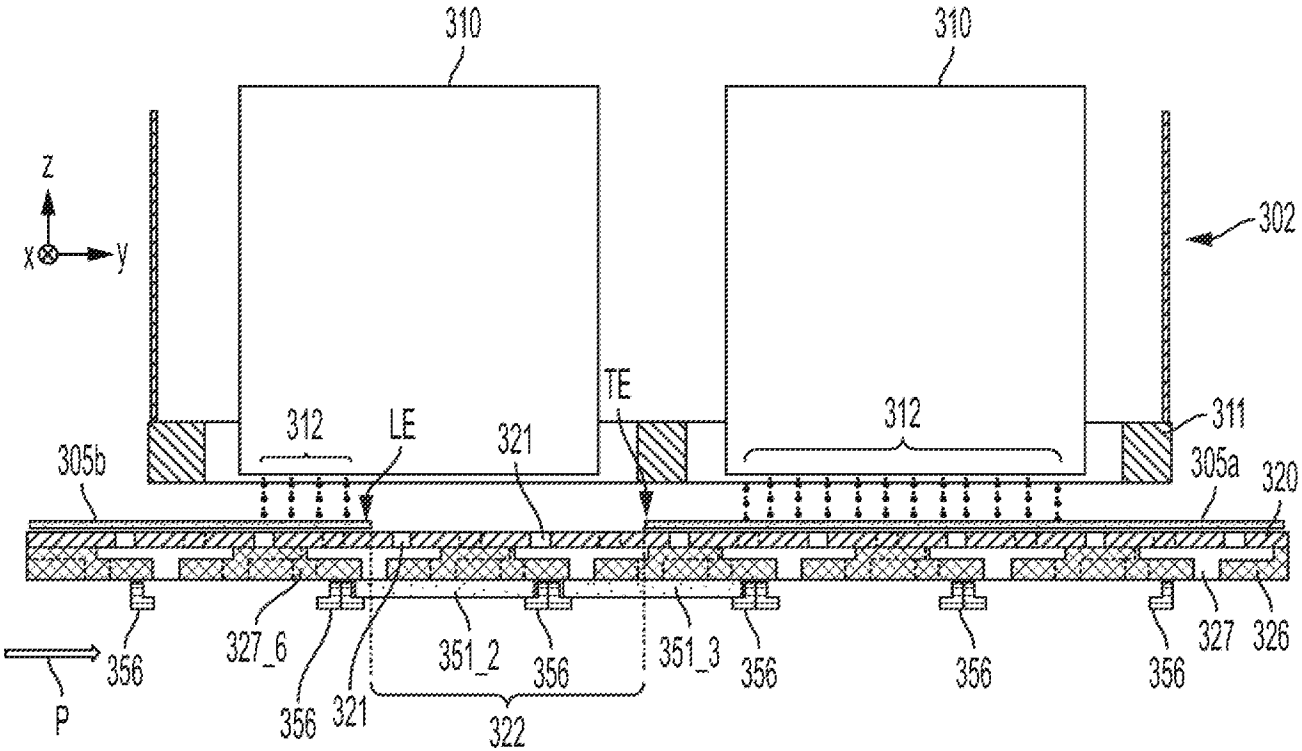
Figure 5E:
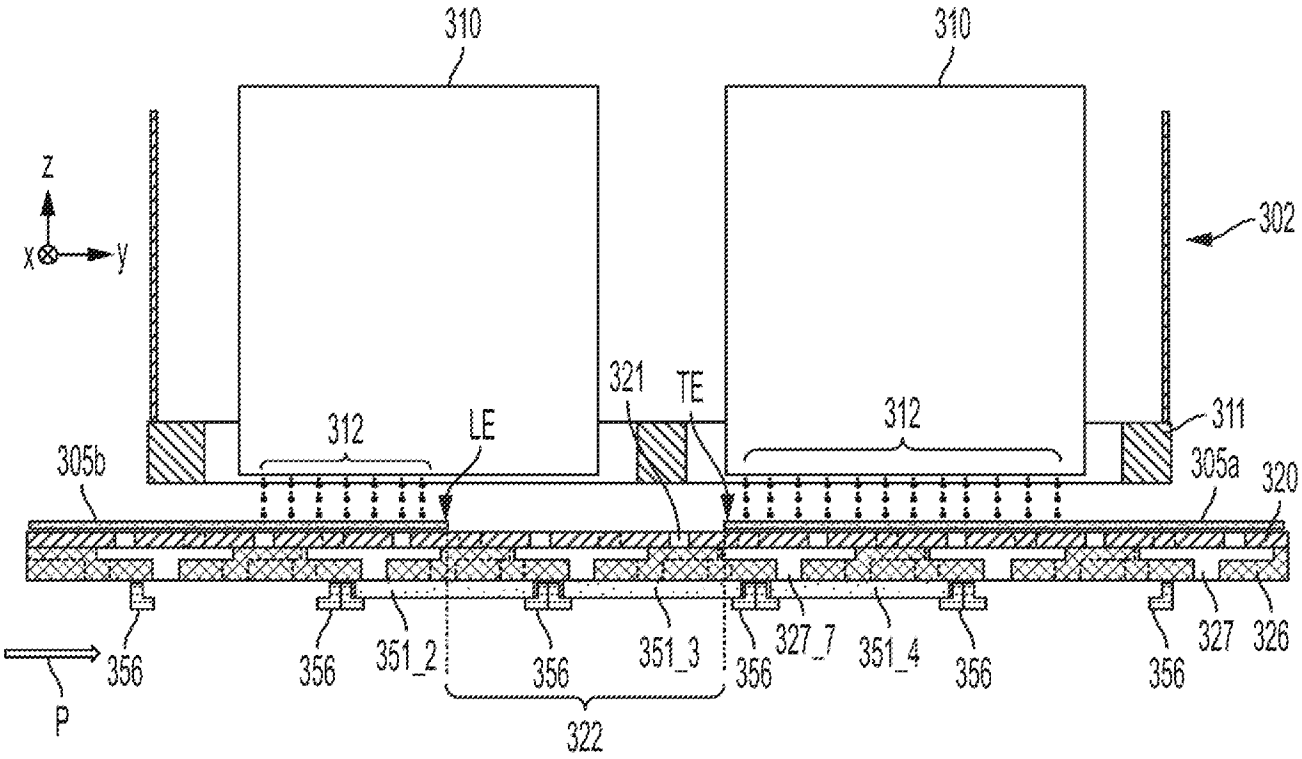
Figure 5F:
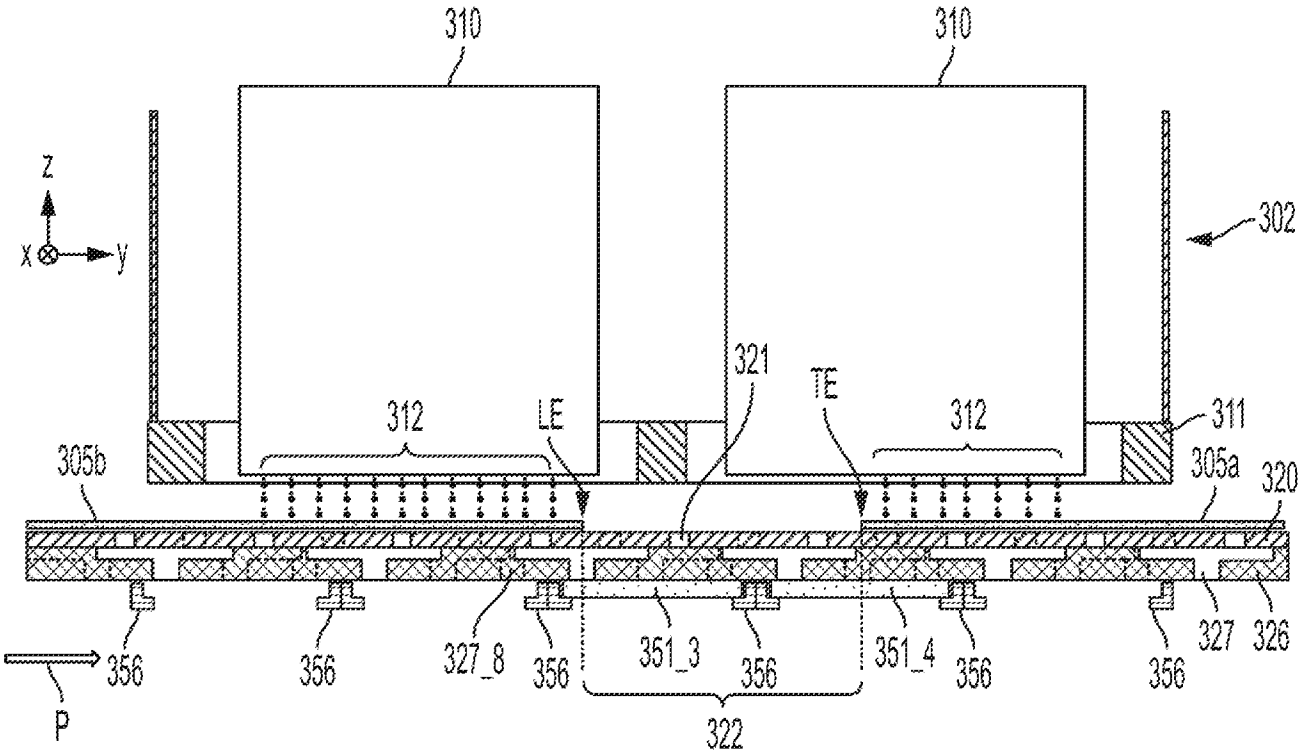
Figure 5G:
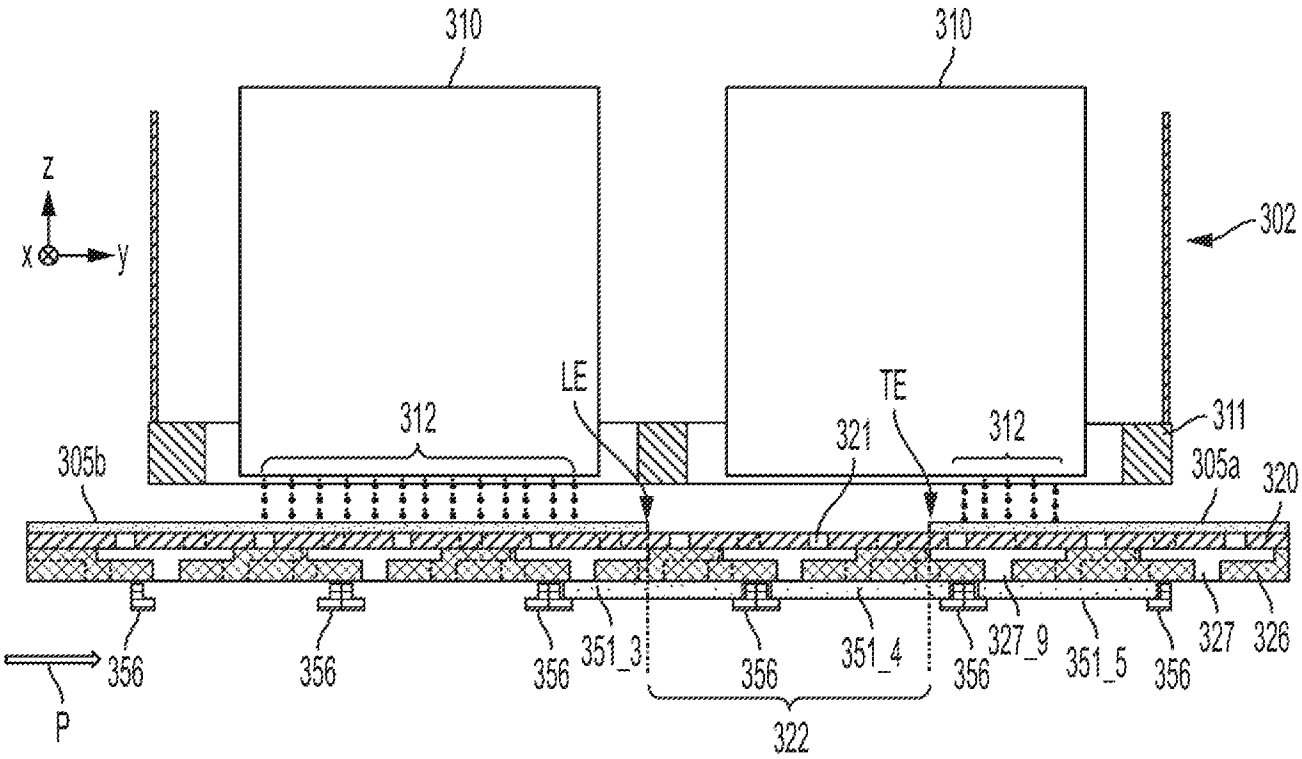
Figure 5H:
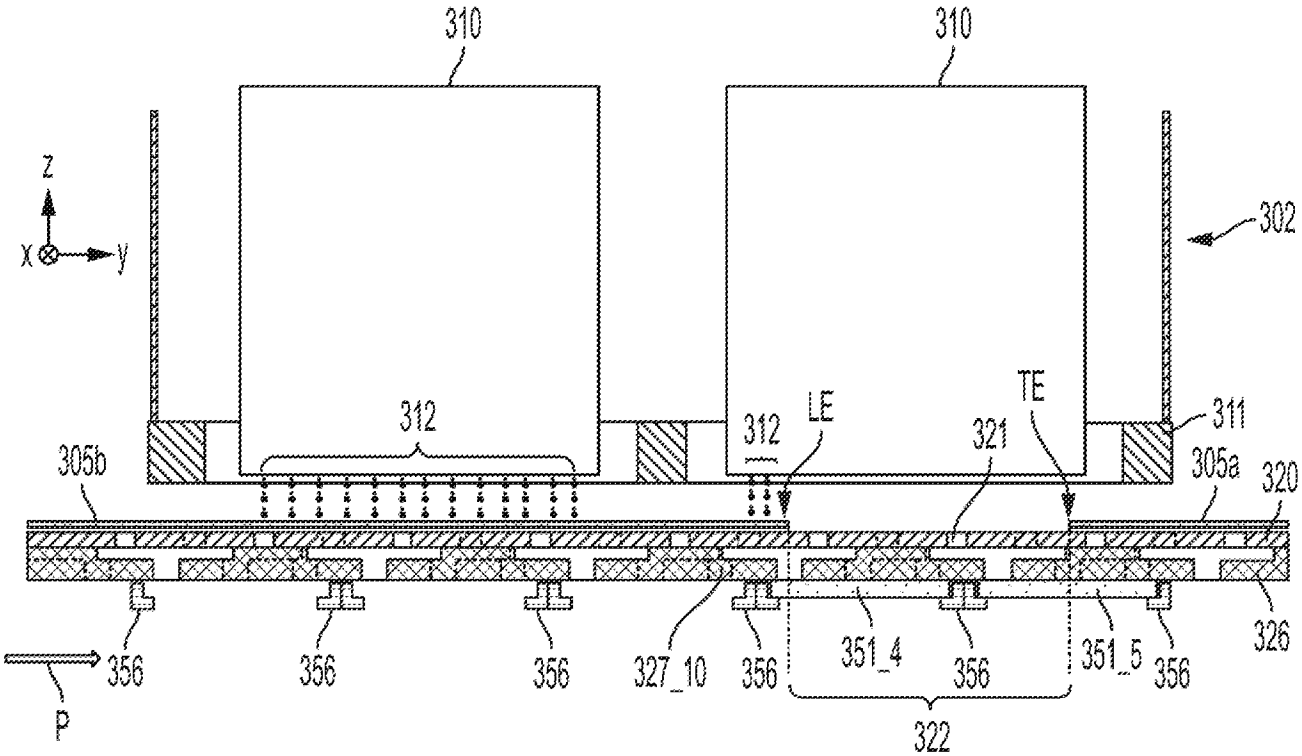
Figure 5I:
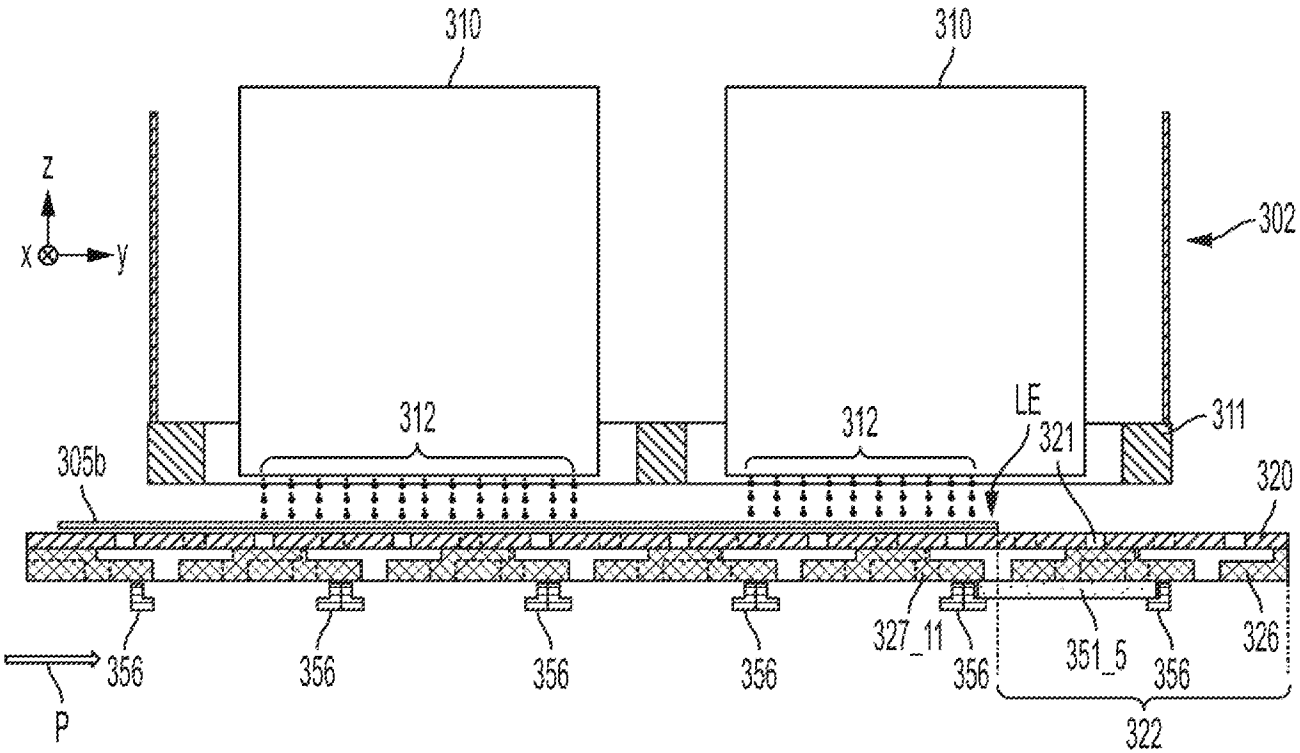
Figure 5J:
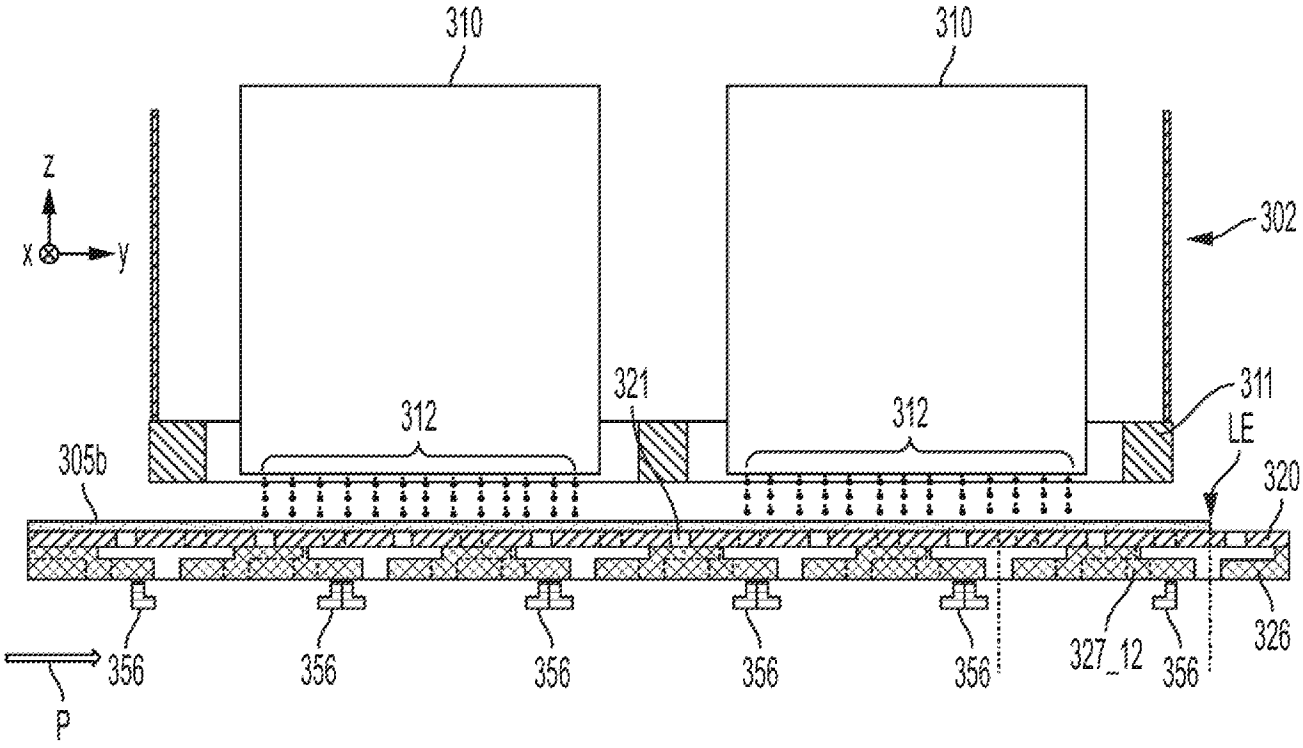
Figure 6A:
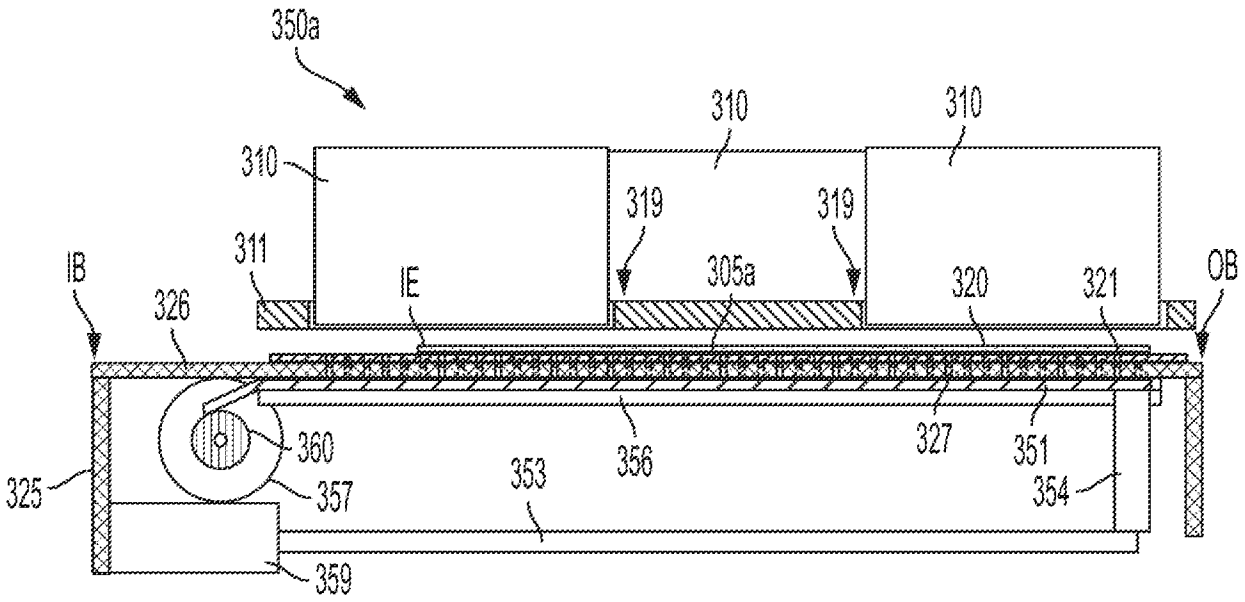
FIGS. 6A-6B are cross-sectional views of the inkjet printing system of FIG. 4, with the cross-section taken along E in FIG. 4.
Figure 6B:
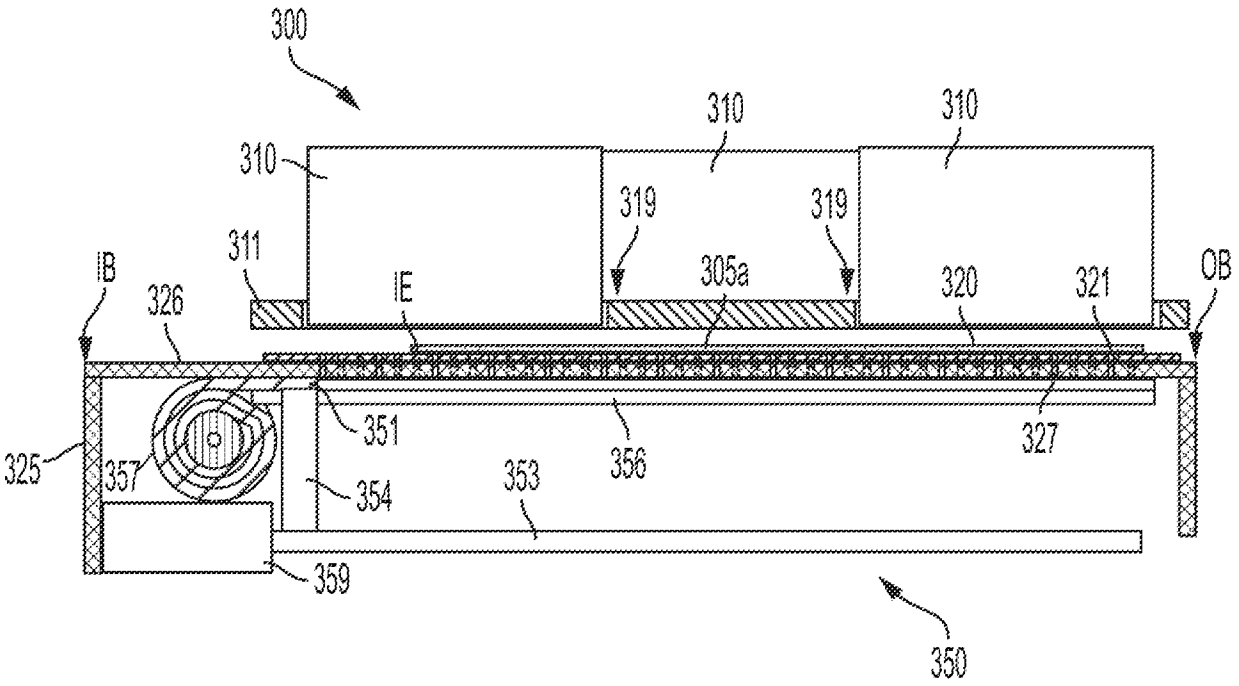

FIGS. 3-6B illustrate a printing system 300, which may be used as the printing system 100 described above with reference to FIG. 2. FIG. 3 comprises a schematic illustrating a portion of the printing system 300 from a side view. FIG. 4 comprises a plan view from above a portion of the printing system 300. In FIG. 4, some components that would not otherwise be visible in the view because they are positioned below other components are illustrated with dashed or dotted lines. FIGS. 5A-5J comprise cross-sections of the printing system 300 with the section taken along line D-D in FIG. 4, with each of FIGS. 5A-5J showing a sequence of states as the print media 305*a* and 305*b* are transported past one of the printhead modules 302. FIGS. 6A-6B comprise cross-sections of the printing system 300 with the section taken along line E-E in FIG. 4, with FIG. 6A illustrating a damper 351 in a deployed (extended) position and FIG. 6B illustrating the damper 351 in an undeployed (retracted) position.

As illustrated in FIG. 3, the printing system 300 compromises an ink deposition assembly 301, a media transport device 303, and an airflow control system 350, which can be used as the ink deposition assembly 101, media transport device 103, and airflow control system 150, respectively. The printing system 300 may also comprise additional components not illustrated in FIGS. 3-6B, such as a control system (e.g., the control system 130).

In the printing system 300, the ink deposition assembly 301 comprises four printhead modules 302 as shown in FIG. 3, with each module 302 having three printheads 310 as shown in FIG. 4. As shown in FIGS. 3 and 4, the printhead models 302 are arranged in series along a process direction P above the media transport device 303, such that the print media 305 is transported sequentially beneath each of the printhead modules 302. The printheads 310 are arranged to eject print fluid (e.g., ink) through respectively corresponding openings 319 in a corresponding carrier plate 311, with a bottom end of the printhead 310 extending down partway into the opening 319. In this embodiment, the printheads 310 are arranged in an offset pattern with one of the printheads 310 being further upstream or downstream than the other two printheads 310 of the same printhead module 302. In other embodiments, different numbers and/or arrangements of printheads 310 and/or printhead modules 302 are used.

In the printing system 300, media transport device 303 comprises a flexible belt providing the movable support surface 320. As shown in FIG. 3, the movable support surface 320 is driven by rollers 329 to move along a looped path, with a portion of the path passing through the ink deposition region 323 of the ink deposition assembly 301. Furthermore, in this embodiment, the vacuum plenum 325 comprises a vacuum platen 326, which forms a top wall of the plenum 325 and supports the movable support surface 320. The platen 326 comprises platen holes 327, which allow fluidic communication between the interior of the plenum 325 and the underside of the movable support surface 320.

In some embodiments, the platen holes 427 may include channels on a top side thereof, as seen in the expanded cutaway of FIG. 3, which may increase an area of the opening of the holes 427 on the top side thereof. Specifically, the platen holes 327 may include a bottom portion 327*a* which opens to a bottom side of the platen 326 and a top portion 327*b* which opens to a top side of the platen 326, with the top portion 327*b* being differently sized and/or shaped than the bottom portion 327*a*. For example, FIGS. 3-5F illustrate an embodiment of the platen holes 327 in which the top portion 327*b* is a channel elongated in the process direction while the bottom portion 327*an* is a through-hole that is less-elongated and has a smaller sectional area (see the enlargement D in FIG. 3 and the dashed-lines in FIG. 4). In some embodiments, multiple holes 327 may share the same top portion 327*b*, or in other words multiple bottom portions 327*a* may be coupled to the same top portion 327*b*. References herein to the dampers 351 blocking a hole 327 refer to blocking at least the bottom portion 327*a* of the hole 327.

The holes 327 are arranged in columns extending in the process direction and rows extending in a cross-process direction, with each column comprising a group of holes 327 that are aligned with one another in the process direction and each row comprising a group of one or more holes 327 aligned with one another in a cross-process direction. In some embodiments, the columns and rows are arranged in a regular grid, but in other embodiments the columns and rows are arranged in other patterns that do not form a regular grid. For example, in some embodiments, such as the embodiment of FIG. 4, the holes 327 (top portion 327*b*, bottom portions 327*a*, or both) of two adjacent columns may be offset or staggered from one another in the process direction—in other words, a hole 327 in one column may not be aligned in the cross-process direction with any holes 327 in an adjacent column. Similarly, in some embodiments the holes 327 (top portion 327*b*, bottom portion 327*a*, or both) of two adjacent rows are offset or staggered from one another in the cross-process direction—in other words, a hole 327 in one row may not be aligned in the process direction with any holes 327 in an immediately adjacent row. In some embodiments, the holes 327 (top portion 327*b*, bottom portion 327*a*, or both) in each individual column are arranged with uniform spacing in the process direction, but in other embodiments some or all of the holes 327 in one or more columns may have non-uniform spacings. In some embodiments, the holes 327 (top portion 327*b*, bottom portion 327*a*, or both) in each individual row are arranged with uniform spacing in the cross-process direction, but in other embodiments some or all of the holes 327 in one or more rows may have non-uniform spacings. In some embodiments, each column has the same number of holes 327 as the other columns and/or each row has the same number of holes 327 as the other rows, but in some embodiments some or all of the columns and/or rows have differing numbers of holes 327. In embodiments in which the holes 327 have bottom portions 327*an* and top portions 327*b* with different shapes/sizes, references herein to the holes 327 being aligned refer to the bottom portions 327*a* of the holes being 327 aligned.

The holes 321 of the movable support surface 320 are disposed such that each hole 321 is aligned in the process direction (y-axis) with a collection of corresponding platen holes 327. In other words, in the printing system 300, each hole 321 is aligned in the with one of the columns of platen holes 327. Thus, as the movable support surface 320 slides across the platen 326, each hole 321 will periodically move over a corresponding platen hole 327, resulting in the hole 321 and the platen hole 327 being temporarily vertically aligned (i.e., aligned in a z-axis direction). When a hole 321 moves over a corresponding platen hole 327, the holes 321 and 327 define an opening that fluidically couples the environment above the movable support surface 320 to the low-pressure state in the vacuum plenum 325, thus generating vacuum suction through the holes 321 and 327. This suction generates a vacuum hold down force on a print medium 305 if the print medium 305 is disposed above the hole 321.

As shown in FIGS. 3-6B, the airflow control system 150 comprises dampers 151 and corresponding actuators 159 to move the dampers 151. The dampers 351 and actuators 359 of FIGS. 3-6B may be used as the dampers 151 and actuators 159 described above in relation to FIG. 2. To simplify the illustrations, one damper 351 and one actuator 159 are illustrated in FIG. 3, and FIGS. 4-5J illustrates seven dampers 351 per printhead module 302, but in practice any number of dampers 351 and actuators 359 may be provided per printhead 310 and/or per printhead module 302. In some embodiments, dampers 351 are provided to collectively block holes 327 that are located under the printheads 310. For example, in some embodiments, dampers 351 are provided to collectively block at least all of the holes 327 that are located under any of printheads 310. In some, embodiments dampers 351 are provided to block holes 327 that are adjacent to, but not under, the printheads 310, such as holes 327 immediately upstream or downstream of each printhead 310. In some embodiments, for each printhead 110, dampers 351 are provided to collectively block the holes 327 that are located under the printhead 310 and also to block holes adjacent to (e.g., immediate upstream or downstream of) the printhead 110. In some embodiments, the dampers 351 are provided to collectively block all of the holes 327 that are located under any carrier plate 311 of a printhead module 302. In some embodiments it is envisioned that at least two dampers 351 are provided for the holes 327 near or under a particular printhead 310; for example, at least one damper 351 can be adjacent an upstream side of the printhead 310 and at least one damper 151 adjacent to the downstream side of the printhead 310.

In the printing system 300, the dampers 351 are disposed under the vacuum platen 326 against a bottom surface thereof, as shown in FIGS. 3 and 5A-6A. As shown in FIGS. 4 and 6A, each damper 351 is configured to extend across the platen 326 in the cross-process direction to block at least one row of holes 327 when in a deployed (extended) configuration. As shown in FIG. 6B, the dampers 351 are also configured to be moved to an undeployed (retracted) configuration in which they do not extend across the platen 326 and do not block holes 327. As shown in FIGS. 5A-6B, the dampers 351 are supported and guided in their motion by rails 356, which extend across the bottom of the platen 326 in the cross-process direction. The dampers 351 comprise elongated strips of solid material and may be made of any suitable material, such as metal, plastic, polymer, etc. In some examples, the damper 351 is flexible to allow redirection of the dampers 351 as they move between retracted and deployed (extended) configurations. The actuator 359 drives the movement of the damper 351 between the deployed (extended) and undeployed (retracted) configurations, as will be described in greater detail below with reference to FIGS. 6A-6B. In FIGS. 5A-5J, each damper 351 is illustrated as blocking three rows of holes 327—for example, as shown in FIG. 5A, the blocker 351_1 blocks the rows corresponding to holes 327_1, 327_2, and 327_3. But in other embodiments each damper 351 could be narrower or wider. Providing more dampers 351 which are narrower may allow for more fine-grained control over which holes 327 are blocked by the dampers 351 at any given time, potentially reducing the impact of the dampers 351 on the ability to maintain hold-down of the print media 305. On the other hand, providing fewer dampers 351 which are wider may allow for simpler control and allow for fewer actuators 359, which may reduce the cost, size, and/or complexity of the system. Those of ordinary skill in the art would understand how to choose the appropriate size of dampers and actuators based on the principles of operation described herein and in consideration of other factors such actuation sensitivities, desired hold down forces, etc.

The actuator 359 drives the movement of the damper 351 between the deployed (extended) and undeployed (retracted) configurations, as will be described in greater detail below with reference to FIGS. 6A-6B. As described above, the airflow control system 350 is configured to extend and retract the dampers 351 at timings based on the position of the inter-media zone 322. A pair of dampers 351 that are aligned in the cross-process direction are operated to deploy and retract at the same timings as one another. Specifically, in the printing system 300, a given damper 351 is deployed when the inter-media zone 322 arrives at an upstream position associated with the damper 351, i.e., when the trail edge TE of a print medium 305 reaches the upstream position. The damper 351 is retracted when the inter-media zone 322 has passed a downstream position associated with the damper 351, i.e., when the lead edge LE of a print medium 305 reaches the downstream position. In other words, in some embodiments, each damper 351 is deployed when the inter-media zone 322 approaches the damper 351 and remains deployed until the inter-media zone 322 has moved past the damper 351. Thus, as the inter-media zone 322 moves past the printheads 310, the dampers 351 deploy and retract in concert with the movement of the inter-media zone 322 to collectively block all of the uncovered holes 327 that are near a printhead 310. The dampers 351 thus prevent or sufficiently inhibit the inter-media zone 322 from inducing crossflows. The retraction of a damper 351 once the inter-media zone has passed it allows the now-unblocked holes 327 associated with that damper 351 to resume their intended role of holding down the print media 305.

The timings for extending and retracting the dampers 351 in the printing system 300 are explained in greater detail below with reference to FIGS. 5A-5J, which illustrate various positions of the inter-media zone 322 at which extension or retraction of the dampers 351 are triggered. FIGS. 5A-5J comprise cross sections taken along D in FIG. 4. Each damper 351 has a first trigger location and a second trigger location associated with it, and the damper 351 is extended when the inter-media zone 322 reaches the first trigger location and retracted when the inter-media zone 322 reaches the second trigger location, which is downstream of the first trigger location. FIGS. 5A-5J illustrate trigger locations of one embodiment, but in other embodiments different trigger locations are used. The first and second trigger locations may be any predetermined locations and can be selected based on a variety of factors, including but not limited to the control and actuator sensitivity, the speed at which the damper can be deployed into the desired position, the hold down force desired, etc.

In practice, it takes a finite amount of time for the damper 351 to fully extend or retract, and during this time while the damper 351 is extending or retracting the inter-media zone 322 continues to move. Thus, in some embodiments, to ensure that the damper 351 is fully deployed when the inter-media zone 322 reaches a desired trigger location ("nominal trigger location"), the actuator 359 may be controlled to start deploying the damper 351 at a time just before the inter-media zone 322 actually reaches the nominal trigger location. In other words, an actual trigger location that is used to trigger the extending or retracting may be offset from the nominal trigger location by some fixed amount to account for the finite amount of time it takes the damper 351 to extend or retract. The known speed of the movable support surface 320 and a known deployment time for the damper 351 may be used to determine the offset. To simplify the description, only the nominal trigger locations are discussed below, but those having ordinary skill in the art would appreciate how to choose when the deployment of the dampers 351 will occur to reach their deployed (extended) configuration at a desired time to coincide with the location of the inter-media zone.

In the embodiment of FIGS. 5A-5J, the trigger locations for the deployment of each damper 351 corresponds to upstream and downstream boundaries of the subsets of holes 327 blocked by the respective damper 351. In this embodiment, the holes 327 have elongated top portions 327*b* and the upstream/downstream edges of the holes 327 are not aligned with the upstream/downstream edges of the dampers 351. Thus, the trigger locations associated with each damper 351 in this embodiment are offset slightly upstream or downstream relative to the edges of the damper 351. In other embodiments (not illustrated), the trigger locations correspond to the upstream and downstream edges of the damper 351.

FIG. 5A illustrates the inter-media zone 322 in a first position. The first position corresponds to the downstream edge of the inter-media zone 322 (i.e., the trail edge TE of the print medium 105*a*) reaching a first trigger location associated with the first damper 351_1. In other words, in the first position the inter-media zone 322 is approaching the first damper 351. Specifically, the inter-media zone 322 reaches the first trigger location when the trail edge TE of the print medium 305*a* is passing (i.e., vertically aligned with) the upstream boundary of the subset of holes 327 that are blocked by the first damper 351_1, or in other words at an upstream edge of the channel 327*b* of the most upstream hole 327 in the subset, which is labeled 327_1 in FIG. 5A. Thus, at (or shortly before) the timing when the inter-media zone 322 reaches the first trigger location, the controller causes the corresponding actuator (not shown) to move the first damper 351_1 to the deployed (extended) configuration. Thus, later when the print media 305*a* moves downstream and ceases to cover the hole 327_1, the damper 351_1 is already deployed and ready to block airflow through the hole 327_1, preventing the hole 327_1 from inducing a crossflow 35 when it becomes uncovered. In the configuration illustrated in FIG. 5A, the other dampers 351 associated with the same printhead module 302 are not deployed and remain in their undeployed (retracted) configurations because the inter-media zone 322 has not yet arrived at the trigger locations associated with those dampers 351.

FIG. 5B illustrates the inter-media zone 322 at a second position. The second position corresponds to the downstream edge of the inter-media zone 322 (i.e., the trail edge TE of the print medium 105*a*) reaching a first trigger location associated with the second damper 351_2 in the series of dampers disposed under the printheads 310 of the print module 302. Specifically, the inter-media zone 322 reaches this trigger location when the trail edge TE of the print medium 305*an* is at the upstream boundary of the subset of holes 327 that are blocked by the second damper 351_2, i.e., at the upstream edge of the hole 327_4. Thus, at (or shortly before) the timing when the inter-media zone 322 reaches the second position, the controller causes one of the actuators (not shown) to move the second damper 351_2 to the deployed (extended) configuration. The first damper 351_1 remains extended in this configuration because the inter-media zone 322 has not yet fully passed the first damper 351_1, and thus both the first and second dampers 351_1 and 351_2 are extended in this configuration. In the state illustrated in FIG. 5B, all parts of the inter-media zone 322 that are near/under the printhead 310 are blocked by the dampers 351_1 and 351_2, and thus crossflows 35 that might have otherwise been induced are prevented. More specifically, the dampers 351 prevent the region $R_1$ from being exposed to the vacuum state below the platen 326, and therefore the region $R_1$ and the region $R_2$ stay at approximately the same pressure. Because the regions $R_1$ and $R_2$ are at approximately the same pressure, there is little to no airflow induced between the regions $R_2$ and $R_1$, and hence little or no crossflows 35. Note that an upstream portion of the inter-media zone 322 is unblocked in this state, but this does not induce any significant crossflows though the ink-ejection region 312 because the unblocked portion of the inter-media zone 322 is relatively distant from the ink-ejection region 312 of the printhead 310.

FIG. 5C illustrates the inter-media zone 322 at a third position. The third position corresponds to the downstream edge of the inter-media zone 322 (i.e., the trail edge TE of the print medium 105*a*) reaching a first trigger location associated with the third damper 351_3. Specifically, the inter-media zone 322 reaches this trigger location when the trail edge TE of the print medium 305*an* is at the upstream boundary of the subset of holes 327 that are blocked by the third damper 351_3, i.e., at the upstream edge of the hole 327_5. Thus, at (or shortly before) the timing when the inter-media zone 322 reaches the third position, the controller causes one of the actuators 359 to move the third damper 351_3 to the deployed (extended) configuration. The first and second damper 351_1, 351_2 remain extended in this state because the inter-media zone 322 has not yet fully passed them. In the state illustrated in FIG. 5C, the portions of the inter-media zone 322 near/under the printheads 310 are blocked by the dampers 351, and thus crossflows 35 that might have otherwise been induced are prevented.

FIG. 5D illustrates the inter-media zone 322 at a fourth position. The fourth position corresponds to the upstream edge of the inter-media zone 122 (i.e., the lead edge LE of print medium 105*b*) reaching a second trigger location associated with the first damper 351_1. In the fourth position, the inter-media zone has passed the first damper 351_1. Specifically, the inter-media zone 322 reaches this trigger location when the lead edge LE of the next print medium 305*b* is at a downstream boundary of the subset of holes 327 blocked by the first damper 351_1, i.e., at the downstream edge of the hole 327_6. Thus, at (or shortly before) the timing when the inter-media zone 322 reaches the fourth position, the controller causes one of the actuators 359 to move the first damper 351_1 back to the undeployed (retracted) configuration. The second and third damper 351_2, 351_3 remain extended in this state because the inter-media zone 322 has not yet fully passed them. The retraction of the first damper 351_1 allows the holes 327 in that vicinity to resume functioning in their intended role of applying hold-down suction force to the print medium 305*b*.

FIG. 5E illustrates the inter-media zone 322 at a fifth position. The fifth position corresponds to the downstream edge of the inter-media zone 322 (i.e., the trail edge TE of the print medium 105*a*) reaching a first trigger location associated with the fourth damper 351_4. Specifically, the inter-media zone 322 reaches this trigger location when the trail edge TE of the print medium 305*an* is at an upstream boundary of the subset of holes 327 blocked by the fourth damper 351_4, i.e., at the upstream edge of the hole 327_7. Thus, at (or shortly before) the timing when the inter-media zone 322 reaches the fifth position, the controller causes one of the actuators 359 to move the fourth damper 351_4 to the deployed (extended) configuration. The second and third dampers 351_2, 351_3 remain extended in this state because the inter-media zone 322 has not yet fully passed them.

FIG. 5F illustrates the inter-media zone 322 at a sixth position. The sixth position corresponds to the upstream edge of the inter-media zone 122 (i.e., the lead edge LE of print medium 105*b*) reaching a second trigger location associated with the second damper 351_2. In other words, in the sixth position the inter-media zone 322 has now passed the second damper 351_2. Specifically, the inter-media zone 322 reaches this trigger location when the lead edge LE of the next print medium 305*b* is at the downstream boundary of the subset of holes 327 blocked by the second damper 351_2, i.e., at the downstream edge of the hole 327_8. Thus, at (or shortly before) the timing when the inter-media zone 322 reaches the sixth position, the controller causes one of the actuators 359 to move the second damper 351_2 back to the undeployed (retracted) configuration. The third and fourth dampers 351_3, 351_4 remain extended in this state because the inter-media zone 322 has not yet fully passed them.

FIG. 5G illustrates the inter-media zone 322 at a seventh position. The seventh position corresponds to the downstream edge of the inter-media zone 322 (i.e., the trail edge TE of the print medium 105*a*) reaching a first trigger location associated with the fifth damper 351_5. Specifically, the inter-media zone 322 reaches this trigger location when the trail edge TE of the print medium 305*an* is at the upstream boundary of the subset of holes 327 blocked by the fifth damper 351_5, i.e., the upstream edge of the hole 327_9. Thus, at (or shortly before) the timing when the inter-media zone 322 reaches the seventh trigger location, the controller causes one of the actuators 359 to move the fifth damper 351_5 to the deployed (extended) configuration. The third and fourth dampers 351_3, 351_4 remain extended in this state because the inter-media zone 322 has not yet fully passed them.

FIGS. 5H-5J illustrate the inter-media zone 322 at eighth through tenth positions, each corresponding to the upstream edge of the inter-media zone 122 (i.e., the lead edge LE of print medium 105*b*) reaching second trigger locations respectively associated with the third damper 351_3, fourth damper 351_4, and fifth damper 351_5, respectively. Specifically, the eighth through tenth positions correspond to the lead edge LE of the print medium 305*b* being at the downstream boundaries of the third damper 351_3, fourth damper 351_4, and fifth damper 351_5, respectively, i.e., the downstream edges of the holes 327_10, 327_11, and 327_12, respectively. Thus, when the inter-media zone 322 reaches the eighth position the third damper 351_3 is retracted (FIG. 5H), when the inter-media zone 322 reaches the ninth position the fourth damper 351_4 is retracted (FIG. 5I), and when the inter-media zone 322 reaches the tenth position the fifth damper 351_5 is retracted (FIG. 5J).

FIGS. 6A-6B comprise cross-sections taken along E in FIG. 4, and illustrate the movement the dampers 351 between the deployed and undeployed (retracted) configurations. To improve clarity, only one damper 351_1 is illustrated in FIGS. 6A-6B. FIG. 6A corresponds to the state illustrated in FIG. 5A, in which the damper 351_1 is in the deployed (extended) configuration. FIG. 6B corresponds to the state illustrated in FIG. 5F, in which the damper 351_1 has been moved to the undeployed (retracted) configurations. As shown in FIG. 6A, when a damper 351 is in the deployed (extended) configuration, it is adjacent to (e.g., in contact with) the bottom of the platen 326 below a row of holes 327. Thus, a damper 351 in the deployed (extended) configuration blocks the bottom openings of a subset of holes 327, thereby preventing air from flowing through the holes 327. As shown in FIG. 6B, in the undeployed (retracted) configuration the damper 351 is moved such that it is no longer under the holes 327, and thus does not block the holes 327.

As shown in FIGS. 6An and 6B, an actuator 359 imparts horizontal motion to a corresponding damper 351, thereby causing the damper 351 to move between the deployed (extended) configuration illustrated in FIG. 6An and the undeployed (retracted) configuration illustrated in FIG. 6B. The actuator 359 is fixed relative to the platen 326 and coupled to the damper 351. The actuator 359 imparts linear motion to the damper 351, thereby causing the damper 351 to move between the deployed (extended) configuration illustrated in FIG. 6An and the undeployed (retracted) configuration illustrated in FIG. 6B. FIGS. 6A-6B illustrate one embodiment in which the actuator 359 is a linear actuator, which is coupled to the damper 351 by a linkage comprising a track 353 and an arm 354. The linear actuator 352 moves the arm 354 linearly along the track 353, and this linear motion of the arm 354 is translated into linear translational motion of a free end of the damper 351 along a cross-process direction. Any device capable of generating linear motion of the arm 354 may be used as the actuator 359. For example, the actuator 359 may comprise a solenoid, a hydraulic actuator, a pneumatic actuator, an electrical motor etc. The track 353 may comprise a hydraulic piston, screw drive, chain drive, cable drive, or any other linkage capable of moving the arm 354 linearly. The actuator 359 is held stationary relative to the vacuum platen 326. For example, the actuator 359 may be secured to the vacuum platen 326 via supports (not illustrated) which may be integral with the platen 326 or secured to the platen 326 using mechanical fasteners, welding, adhesives, or any other fastening technique. In some embodiments, the actuator 359 may be secured to some other structure, such as a bottom, side, or interior wall of the vacuum plenum 325.

In the embodiment of FIGS. 6A-6B, the actuator 359 is positioned on an inboard side of the damper 351 and is configured to move an outboard end of the damper along the rails 356. However, in other embodiments the actuator 359 is positioned differently (e.g., on an outboard side of the damper 351) and/or the inboard side of the damper is configured to be moved along the rails 356.

In some embodiments, such as that illustrated in FIGS. 6A-6B for example, to allow for more a more compact system, the damper 351 may be flexed and redirected as the damper 351 moves between deployed (extended) and undeployed (retracted) configurations. Thus, the damper 351 may not be straight and horizontal while in the retracted configuration. For example, in the embodiment of FIGS. 6A-6B, one end of the damper 351 is coupled to a rotatable hub 360, while the other end is engaged with the rails 356 and coupled to the arm 354. Thus, as the damper 351 moves to its undeployed, retracted configuration, it flexes and is wound around a hub 360 (see FIG. 6B), and as the damper 351 moves to its deployed, extended configuration, it is unwound from the hub 360 (see FIG. 6A). The extension/retraction of the damper 351 illustrated in FIGS. 6A-6B is thus analogous to a measuring tape extension and retraction. A housing 357 may redirect the damper 351 to guide it to wind around the hub 360. In such embodiments, the damper 351 may be a flexible structure that can move without between the extended and retracted configurations without permanent deformation.

Figure 7:
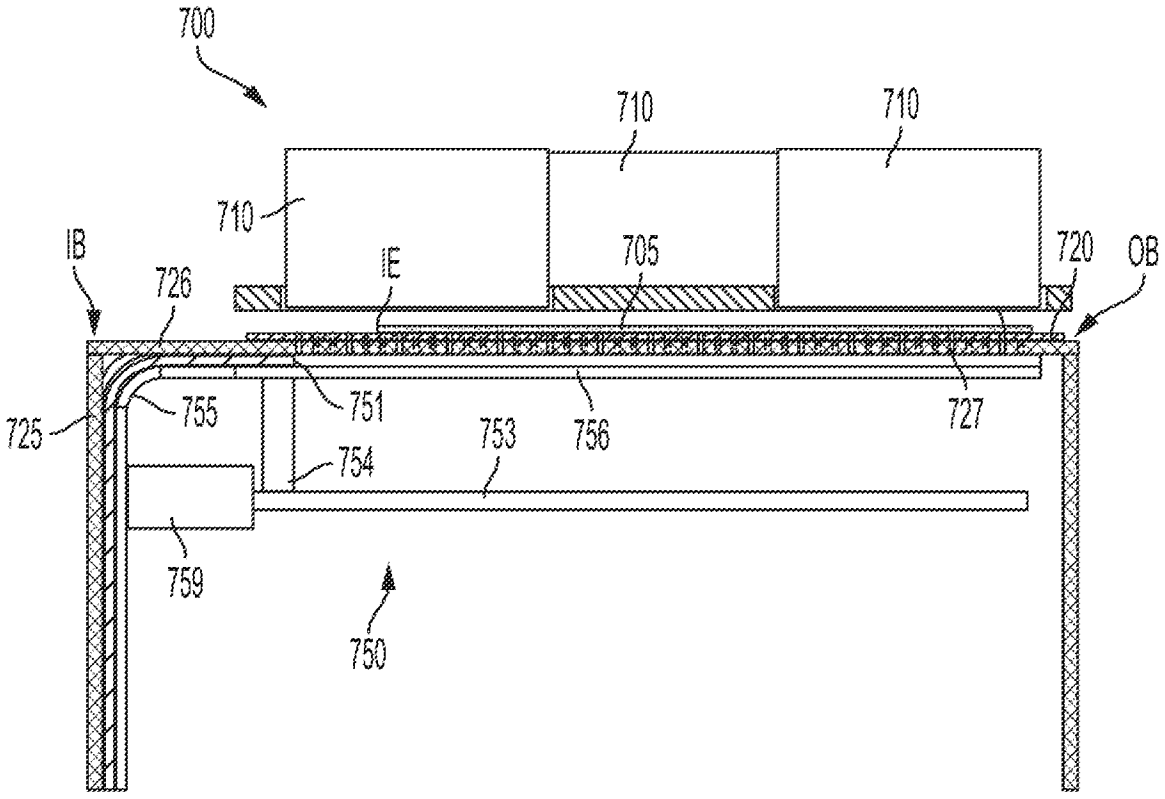
FIG. 7 is a cross-sectional view of an embodiment of an inkjet printing system, with the cross-section taken along a cross-process direction.

FIG. 7 illustrates another embodiment of a printing assembly, namely the printing assembly 700. The printing assembly 700 comprises printheads 710, a vacuum plenum 725 comprising a vacuum platen 726 with holes 727, a movable support surface 720 with holes 721, and an airflow control system 750. The airflow control system 750 comprises blockers 751, an actuator 750, an arm 754, a track 753, and rails 756. The printing assembly 700 may be used as the printing assembly 100; specifically, the components of the printing assembly 700 may be used as the respective components of the printing assembly having the same names. The printing assembly 700 may also comprise additional components not illustrated in FIG. 7, such as a control system or any of the other components described herein, such as any of the components illustrated in FIGS. 2 and 3. The components of the printing assembly 700 are similar to corresponding components of printing assembly 300 having the same names, except for differences noted below and shown in the Figures, and thus duplicative description of the similar parts and their operation is omitted. A difference between the printing assembly 700 and the printing assembly 300 is that, rather than winding the damper around a hub in the undeployed (retracted) configuration as in the printing assembly 300, in the printing assembly 700 the damper is redirected so that in the retracted configuration an end portion of the damper 751 extends linearly in a different direction than the cross-process direction. For example, in FIG. 7 the damper 751 is redirected so that its end portion extends vertically along a side wall of the vacuum plenum 425 when in the undeployed (retracted) configuration. The redirection of the damper 751 is effected by a guide structure 755, such as rails, a track, etc.

Figure 8:
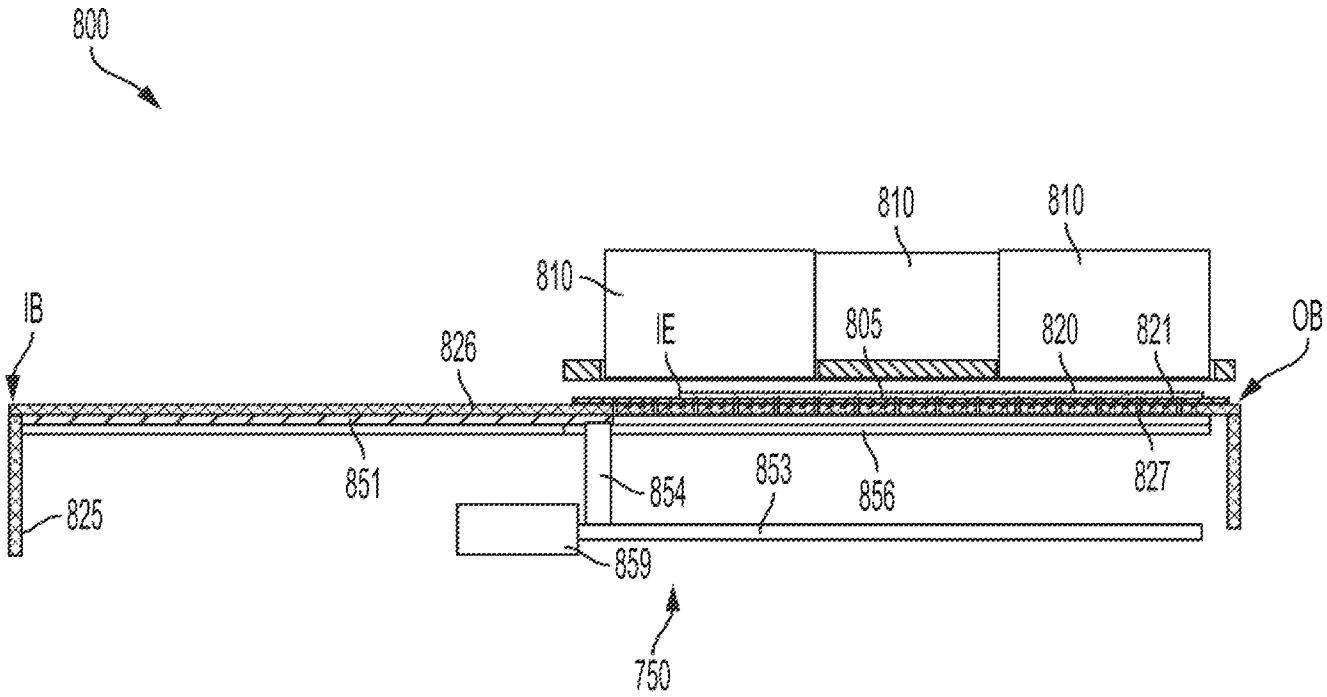
FIG. 8 is a cross-sectional view of an embodiment of an inkjet printing system, with the cross-section taken along a cross-process direction.

FIG. 8 illustrates another embodiment of a printing assembly, namely the printing assembly 800. The printing assembly 800 comprises printheads 810, a vacuum plenum 825 comprising a vacuum platen 826 with holes 828, a movable support surface 820 with holes 821, and an airflow control system 850. The airflow control system 850 comprises blockers 851, an actuator 850, an arm 854, a track 853, and rails 856. The printing assembly 800 may be used as the printing assembly 100; specifically, the components of the printing assembly 800 may be used as the respective components of the printing assembly having the same names. The printing assembly 800 may also comprise additional components not illustrated in FIG. 8, such as a control system or any of the other components described herein, such as any of the components illustrated in FIGS. 2 and 3. The components of the printing assembly 800 are similar to corresponding components of printing assembly 300 having the same names, except for differences noted below and shown in the Figures, and thus duplicative description of the similar parts and their operation is omitted. A difference between the printing assembly 800 and the printing assemblies 300 and 700 is that, rather than winding the damper around a hub or redirecting the damper in the undeployed (retracted) configuration, in the printing assembly 800 the damper 851 remains straight without bending as the damper 851 is moved between undeployed (retracted) and deployed (extended) configurations. Thus, in the undeployed (retracted) configuration the damper 851 is positioned laterally to the side of the deposition region. In some embodiments, as illustrated in FIG. 8, the vacuum plenum 825 and/or other parts of the printing system 800 may thus be relatively wide to accommodate the damper 851 in the undeployed (retracted) configuration. In other embodiments (not illustrated), the damper 851 may extend outside of the plenum 825 in the retracted configuration, such as through an aperture in the side wall of the plenum 825.

Although the embodiments of the airflow control systems described above are illustrated and described in the context of the specific ink deposition assemblies and media transport devices, the same airflow control systems could be used in other embodiments of the printing system having differently configured ink deposition assemblies and media transport devices. For example, the various embodiments of the airflow control systems could be used in printing systems with different types of movable support surfaces, different types of vacuum plenums, different types of vacuum platens, different numbers and/or types of printhead modules, and so on.

This description and the accompanying drawings that illustrate various aspects and embodiments should not be taken as limiting—the claims, including equivalents, define the protected scope of the disclosed inventions. Various mechanical, compositional, structural, electrical, and operational changes may be made without departing from the spirit and scope of this description and the claims. In some instances, well-known circuits, structures, and techniques have not been shown or described in detail in order not to obscure the invention. Like numbers in two or more figures represent the same or similar elements.

As used herein, "blocking" a hole (e.g., hole 127, 327, 727, 827) refers to positioning an object under the opening of the hole such that it covers the opening and is in sufficiently close proximity to the platen that the presence of the object prevents airflow through the hole. In this context, a damper (e.g., damper 151, 351, 751, 851) "preventing" air from flowing through the holes means that the damper creates a relatively high impedance state for the holes such that airflow through the holes is significantly reduced, as compared to a completely open state (e.g., impedance is increased tenfold and/or airflow is decreased tenfold). Thus, blocking the holes and preventing airflow does not necessarily require a hermetic seal or the strict elimination of all airflow.

Further, the terminology used herein to describe aspects of the invention, such as spatial and relational terms, is chosen to aid the reader in understanding example embodiments of the invention but is not intended to limit the invention. For example, spatial terms—such as "upstream", "downstream", "beneath", "below", "lower", "above", "upper", "proximal", "distal", "up", "down", and the like—may be used herein to describe directions or one element's or feature's spatial relationship to another element or feature as illustrated in the figures. These spatial terms are used relative to the poses illustrated in the figures, and are not limited to a particular reference frame in the real world. Thus, for example, the direction "up" in the figures does not necessarily have to correspond to an "up" in a world reference frame (e.g., away from the Earth's surface). Furthermore, if a different reference frame is considered than the one illustrated in the figures, then the spatial terms used herein may need to be interpreted differently in that different reference frame. For example, the direction referred to as "up" in relation to one of the figures may correspond to a direction that is called "down" in relation to a different reference frame that is rotated 180 degrees from the figure's reference frame. As another example, if a device is turned over 180 degrees in a world reference frame as compared to how it was illustrated in the figures, then an item described herein as being "above" or "over" a second item in relation to the Figures would be "below" or "beneath" the second item in relation to the world reference frame. Thus, the same spatial relationship or direction can be described using different spatial terms depending on which reference frame is being considered. Moreover, the poses of items illustrated in the figure are chosen for convenience of illustration and description, but in an implementation in practice the items may be posed differently.

The term "process direction" refers to a direction that is parallel to and pointed in the same direction as an axis along which the print media moves as is transported through the deposition region of the ink deposition assembly. Thus, the process direction is a direction parallel to the y-axis in the Figures and pointing in a positive y-axis direction. Upstream, downstream, trail edge, and lead edge are intended to be relative to the process direction.

The term "cross-process direction" refers to a direction perpendicular to the process direction and parallel to the movable support surface. At any given point, there are two cross-process directions pointing in opposite directions, i.e., an "inboard" cross-process direction and an "outboard" cross-process direction. Thus, considering the reference frames illustrated in the Figures, a cross-process direction is any direction parallel to the x-axis, including directions pointing in a positive or negative direction along the x-axis. References herein to a "cross-process direction" should be understood as referring generally to any of the cross-process directions, rather than to one specific cross-process direction, unless indicated otherwise by the context. Thus, for example, the statement "the damper is movable in a cross-process direction" means that the damper can move in an inboard direction, outboard direction, or both directions.

The terms "upstream" and "downstream" may refer to directions parallel to a process direction, with "downstream" referring to a direction pointing in the same direction as the process direction (i.e., the direction the print median are transported through the ink deposition assembly) and "upstream" referring to a direction pointing opposite the process direction. In the Figures, "upstream" corresponds to a negative y-axis direction, while "downstream" corresponds to a positive y-axis direction. The terms "upstream" and "downstream" may also be used to refer to a relative location of element, with an "upstream" element being displaced in an upstream direction relative to a reference point and a "downstream" element being displaced in a downstream direction relative to a reference point. In other words, an "upstream" element is closer to the beginning of the path the print media takes as it is transported through the ink deposition assembly (e.g., the location where the print media joins the movable support surface) than is some other reference element. Conversely, a "downstream" element is closer to the end of the path (e.g., the location where the print media leaves the support surface) than is some other reference element. The reference point of the other element to which the "upstream" or "downstream" element is compared may be explicitly stated (e.g., "an upstream side of a printhead"), or it may be inferred from the context.

The terms "inboard" and "outboard" refer to cross-process directions, with "inboard" referring to one to cross-process direction and "outboard" referring to a cross-process direction opposite to "inboard." In the Figures, "inboard" corresponds to a positive x-axis direction, while "outboard" corresponds to a negative x-axis direction. The terms "inboard" and "outboard" also refer to relative locations, with an "inboard" element being displaced in an inboard direction relative to a reference point and with an "outboard" element being displaced in an outboard direction relative to a reference point. The reference point may be explicitly stated (e.g., "an inboard side of a printhead"), or it may be inferred from the context.

The term "vertical" refers to a direction perpendicular to the moving support surface in the deposition region. At any given point, there are two vertical directions pointing in opposite directions, i.e., an "upward" direction and an "downward" direction. Thus, considering the reference frames illustrated in the Figures, a vertical direction is any direction parallel to the z-axis, including directions pointing in a positive z-axis direction ("up") or negative z-axis direction ("down").

The term "horizontal" refers to a direction parallel to the movable support surface in the deposition region (or tangent to the movable support surface in the deposition region, if the movable support surface is not flat in the deposition region). Horizontal directions include the process direction and cross-process directions.

The term "vacuum" has various meanings in various contexts, ranging from a strict meaning of a space devoid of all matter to a more generic meaning of a relatively low pressure state. Herein, the term "vacuum" is used in the generic sense, and should be understood as referring broadly to a state or environment in which the air pressure is lower than that of some reference pressure, such as ambient or atmospheric pressure. The amount by which the pressure of the vacuum environment should be lower than that of the reference pressure to be considered a "vacuum" is not limited and may be a small amount or a large amount. Thus, "vacuum" as used herein may include, but is not limited to, states that might be considered a "vacuum" under stricter senses of the term.

The term "air" has various meanings in various contexts, ranging from a strict meaning of the atmosphere of the Earth (or a mixture of gases whose composition is similar to that of the atmosphere of the Earth), to a more generic meaning of any gas or mixture of gases. Herein, the term "air" is used in the generic sense, and should be understood as referring broadly to any gas or mixture of gases. This may include, but is not limited to, the atmosphere of the Earth, an inert gas such as one of the Noble gases (e.g., Helium, Neon, Argon, etc.), Nitrogen ($N_2$) gas, or any other desired gas or mixture of gases.

In addition, the singular forms "a", "an", and "the" are intended to include the plural forms as well, unless the context indicates otherwise. And, the terms "comprises", "comprising", "includes", and the like specify the presence of stated features, steps, operations, elements, and/or components but do not preclude the presence or addition of one or more other features, steps, operations, elements, components, and/or groups. Components described as coupled may be electrically or mechanically directly coupled, or they may be indirectly coupled via one or more intermediate components, unless specifically noted otherwise. Mathematical and geometric terms are not necessarily intended to be used in accordance with their strict definitions unless the context of the description indicates otherwise, because a person having ordinary skill in the art would understand that, for example, a substantially similar element that functions in a substantially similar way could easily fall within the scope of a descriptive term even though the term also has a strict definition.

Elements and their associated aspects that are described in detail with reference to one embodiment may, whenever practical, be included in other embodiments in which they are not specifically shown or described. For example, if an element is described in detail with reference to one embodiment and is not described with reference to a second embodiment, the element may nevertheless be claimed as included in the second embodiment.

What is claimed is:

1. A printing system, comprising:

an ink deposition assembly comprising one or more printheads arranged to eject a print fluid to a deposition region of the ink deposition assembly;

a media transport device comprising a movable support surface, the media transport device configured to hold a print medium against the movable support surface by vacuum suction through holes in the media transport device and transport the print medium along a process direction though the deposition region, the holes arranged in columns extending in the process direction and in rows extending in a cross-process direction perpendicular to the process direction; and an airflow control system comprising:

a damper that is moveable in the cross-process direction between a deployed configuration and an undeployed configuration, the damper blocking at least one row of the holes in the deployed configuration and not blocking the at least one row of the holes in the undeployed configuration; and an actuator operably coupled to the damper and configured to move the damper between the undeployed configuration and the deployed configuration.

2. The printing system of claim 1, comprising:

a controller configured to cause the actuator to selectively move the damper between the undeployed configuration and the deployed configuration to selectively block the at least one row of the holes based on a position of an inter-media zone between adjacent print media held against the movable support surface.

3. The printing system of claim 2, wherein the controller is configured to cause the actuator to move the damper from the undeployed configuration to the deployed configuration in response to a downstream edge of the inter-media zone reaching a first position aligned with an upstream edge of the damper, wherein upstream and downstream are defined relative to the process direction.

4. The printing system of claim 3, wherein the controller is configured to cause the actuator to move the damper from the deployed configuration to the undeployed configuration in response to an upstream edge of the inter-media zone reaching a second position aligned with a downstream edge of the damper.

5. The printing system of claim 1, wherein the at least one row of the holes blocked by the damper comprise one or any combination of:

a row of the holes upstream of and adjacent to one of the printheads;

a row of the holes downstream of and adjacent to one of the printheads;

a row of the holes located under one of the printheads; and a row of the holes located under a printhead module, the printhead module comprising a carrier plate and a plurality of the printheads arranged to eject the printing fluid through openings in the carrier plate.

6. The printing system of claim 1, wherein the airflow control system further comprises:

a plurality of dampers, the damper being one of the plurality of dampers, each of the plurality of dampers being independently movable in the cross-process direction between undeployed and deployed configurations; and a plurality of actuators, the actuator being one of the plurality of actuators, each of the plurality of actuators being operably coupled to a corresponding one of the plurality of dampers and configured to move a corresponding one of the plurality of dampers.

7. A printing system, comprising:

an ink deposition assembly comprising one or more printheads arranged to eject a print fluid to a deposition region of the ink deposition assembly;

a media transport device comprising a movable support surface, the media transport device configured to hold a print medium against the movable support surface by vacuum suction through holes in the media transport device and transport the print medium along a process direction though the deposition region, the holes arranged in columns extending in the process direction and in rows extending in a cross-process direction perpendicular to the process direction; and an airflow control system comprising:

a plurality of dampers, each of the plurality of dampers being independently movable in the cross-process direction between undeployed and deployed configurations and blocking at least one row of the holes in the deployed configuration and not blocking the at least one row of the holes in the undeployed configuration;

a plurality of actuators, each of the plurality of actuators being operably coupled to a corresponding one of the plurality of dampers and configured to move a corresponding one of the plurality of dampers between the undeployed and deployed configurations; and a controller configured to cause the plurality of actuators to independently move the plurality of dampers between the deployed and undeployed configurations based on the position of an inter-media zone between adjacent print media held against the movable support surface.

8. The printing system of claim 7, comprising:

one or more printhead modules, each comprising a carrier plate and a plurality of printheads of the one or more printheads arranged to eject the printing fluid through openings in the carrier plate;

wherein the plurality of dampers are associated with one of the printhead modules and are arranged to collectively block at least each row of the holes located under the associated printhead module.

9. The printing system of claim 8, wherein the one or more printhead modules comprise a plurality of printhead modules, and the plurality of dampers are arranged in a plurality of groups with each group of the plurality of dampers being associated with one of the plurality of printhead modules and being arranged to collectively block holes located under the associated printhead module in a deployed configuration of the group of dampers.

10. The printing system of claim 1, wherein the actuator comprises an arm configured to translate linearly, and the arm is coupled to the damper such that linear translation of the arm moves the damper from the undeployed configuration to the deployed configuration.

11. The printing system of claim 10, wherein:

the arm is coupled to an end portion of the damper, and linear translation of the arm moves the end portion of the damper along the cross-process direction.

12. The printing system of claim 11, wherein:

the end portion of the damper is a first end portion, the damper having a second end portion, opposite the first end portion, coupled to a hub, and the damper is wound on the hub in the undeployed configuration and unwound relative to the hub in the deployed configuration.

13. The printing system of claim 10, wherein the actuator comprises a hydraulic or pneumatic piston operably coupled to the arm.

14. The printing system of claim 1, wherein the damper is flexible along the cross-process direction, and the damper is constrained to move along a path such that as a first end portion of the damper moves along the cross-process direction the damper is flexed and redirected such that another portion of the damper moves in a direction other than the cross-process direction.

15. The printing system of claim 1, wherein:

the media transport device comprises a vacuum platen comprising the holes, the movable support surface comprises a belt configured to slide over a first surface of the vacuum platen, and the damper is adjacent a second surface of the vacuum platen opposite to the first surface.

16. A method of operating a printing system, comprising:

transporting a print medium along a process direction through a deposition region of a printhead of the printing system, wherein the print medium is held during the transporting against a moving support surface of a media transport device via vacuum suction through holes in the media transport device, the holes arranged in columns extending in the process direction and in rows extending in a cross-process direction perpendicular to the process direction;

ejecting print fluid from the printhead to deposit the print fluid to the print medium in the deposition region; and controlling an airflow control system to selectively block at least one row of the holes by moving a damper along the cross-process direction between a deployed configuration in which the damper blocks at least one row of the holes and an undeployed configuration in which the damper does not block any of the holes.

17. The method of claim 16, wherein selectively blocking the at least one row of the holes comprises moving the damper between the deployed and undeployed configurations based on a position of an inter-media zone between adjacent print media held against the moving support surface.

18. The method of claim 17, wherein selectively blocking the at least one row of the holes comprises moving the damper from the undeployed configuration to the deployed configuration in response to a downstream edge of the inter-media zone reaching a first position aligned with an upstream edge of the damper.

19. The method of claim 17, wherein selectively blocking the at least one row of the holes comprises moving the damper from the deployed configuration to the undeployed configuration in response to an upstream edge of the inter-media zone reaching a second position aligned with a downstream edge of the damper.

20. The method of claim 16, wherein the at least one row of the holes blocked by the damper comprise one or any combination of:

a row of the holes upstream of and adjacent to the printhead;

a row of the holes downstream of and adjacent to the printhead;

a row of the holes located under the printhead; and a row of the holes located under a printhead module that comprises a plurality of printheads including the printhead.

* * * * *